US005620948A

United States Patent [19]

Tipton

[11] Patent Number: 5,620,948

[45] Date of Patent: Apr. 15, 1997

[54] ADDITIVE COMBINATIONS FOR LUBRICANTS AND FUNCTIONAL FLUIDS

[75] Inventor: Craig D. Tipton, Perry, Ohio

[73] Assignee: The Lubrizol Corporation, Wickliffe, Ohio

[21] Appl. No.: 667,249

[22] Filed: Jun. 20, 1996

Related U.S. Application Data

[63] Continuation-in-part of Ser. No. 444,186, May 18, 1995, Pat. No. 5,569,644.

[51] Int. Cl.[6] ..... C10M 141/02

[52] U.S. Cl. ..... 508/159; 508/189; 508/185; 508/438; 508/542

[58] Field of Search ..... 508/159, 185, 508/189, 438, 542

[56] References Cited

U.S. PATENT DOCUMENTS

| | | | |
|---|---|---|---|
| 3,359,203 | 12/1967 | O'Halloran | 252/46.6 |
| 3,702,300 | 11/1972 | Coleman | 252/51.5 |
| 3,980,569 | 9/1976 | Pindar et al. | 252/51.5 R |
| 4,032,461 | 6/1977 | Hoke | 252/46.7 |
| 4,053,428 | 10/1977 | Pindar et al. | 252/52 A |
| 4,208,357 | 6/1980 | Hoke | 260/978 |
| 4,282,171 | 8/1981 | Hoke | 260/928 |
| 4,454,059 | 6/1984 | Pindar et al. | 252/51.5 R |
| 4,455,243 | 6/1984 | Liston | 252/49.6 |
| 4,495,088 | 1/1985 | Liston | 252/32.7 |
| 4,584,115 | 4/1986 | Davis | 252/49.6 |
| 4,670,169 | 6/1987 | Adams et al. | 252/46.7 |
| 4,758,362 | 7/1988 | Butke | 252/47 |
| 5,053,152 | 10/1991 | Steckel | 252/51.5 |

FOREIGN PATENT DOCUMENTS

| | | |
|---|---|---|
| 1347845 | 2/1974 | United Kingdom . |
| WO8805810 | 8/1988 | WIPO . |

*Primary Examiner*—Jacqueline V. Howard

*Attorney, Agent, or Firm*—William J. Connors; Frederick D. Hunter

[57] ABSTRACT

This invention relates to a composition, comprising: (A) a Mannich dispersant having a base number in the range of about 45 to about 90; (B) a boron compound; and (C) an organic phosphorus acid or ester, or derivative of said phosphorus acid or ester. In one embodiment, this composition further comprises (D) a thiocarbamate. In one embodiment, this composition further comprises (E) a nitrogen-containing ester of a carboxy-containing interpolymer. These compositions are useful as additives for lubricants and functional fluids, and are particularly useful as additives for automatic transmission fluids for enhancing the torque characteristics such automatic transmission fluids.

12 Claims, No Drawings

ADDITIVE COMBINATIONS FOR LUBRICANTS AND FUNCTIONAL FLUIDS

This is a continuation-in-part of copending application(s) Ser. No. 08/444,186 filed May 18, 1995, now U.S. Pat. No. 5,569,644.

TECHNICAL FIELD

This invention relates to additive combinations for use in lubricants and functional fluid. More particularly, this invention relates to combinations of (A) acylated amines exhibiting high base numbers, (B) boron compounds, and (C) organic phosphorus acids, ester or derivatives, which are useful as additives for lubricants and functional fluids and are particularly suitable for use as additives for automatic transmission fluids.

BACKGROUND OF THE INVENTION

Automatic transmission fluids are used in passenger car and commercial vehicle automatic transmissions, as well as in powershift transmissions in off-highway construction, agricultural and mining equipment, and in automotive, industrial, mobile, and marine hydraulic systems.

Three types of transmission fluids in use are DEXRON®-III primarily for General Motors transmissions, MERCON® for post-1981 Ford transmissions, and Type F (meeting Ford's M2C33F Specification) for pre-1978 and some pre-1981 Ford transmissions. DEXRON®-III went into effect on Jan. 1, 1995. Ford revised its MERCON® specification effective Jan. 1, 1994.

The foregoing specifications require automatic transmission fluids to exhibit, among other things, high frictional midpoint dynamic torque values while maintaining low delta torque values (difference between the maximum torque and the midpoint torque). The attainment of such torque values can be realized by using automatic transmission fluids containing the inventive additive combinations.

U.S. Pat. Nos. 5,053,152 discloses dispersants for use in lubricant and fuel compositions obtained by condensing a hydroxyalkyl or hydroxyaryl compound with an amine compound. These dispersants are produced by the acid catalyzed condensation of the amine reactant with the hydroxy reactant. The reference indicates that the examples disclose the preparation of dispersants with high TBN (total base number) values in the range of 45–50. The reference also indicates that lubricants and functional fluids (e.g., automatic transmission fluids) containing these dispersants can also include a zinc dialkyl phosphorodithioates.

U.S. Pat. No. 4,584,115 discloses that reaction products of boric acid or boron trioxide with epoxides having at least 8 carbon atoms are useful antiwear, friction-modifying and rust-inhibiting additives for lubricants. U.S. Pat. Nos. 4,455,243 and 4,495,088 disclose lubricating oils containing borated fatty acid esters of glycerol.

The use of phosphorus-containing amides as antiwear agents for use in lubricant compositions is disclosed in U.S. Pat. Nos. 4,032,461; 4,208,357; 4,282,171; and 4,670,169. Phosphorus-containing esters useful as antiwear agents in lubricating compositions are disclosed in U.S. Pat. No. 3,359,203. The use of such esters as E.P. agents in lubricant compositions is disclosed in U.K. Patent 1,347,845. WO 88/05810 discloses gear oil compositions which contain hydrocarbyl phosphite esters where the hydrocarbyl groups have 1 to 30 carbon atoms.

U.S. Pat. No. 4,758,362 discloses thiocarbamate additives for use in low phosphorus or phosphorus-free lubricating compositions. The additive has the formula $$R_1R_2N\overset{\overset{\displaystyle X}{|}}{C}-S(CR_3R_4)_aZ$$

wherein X is O or S, and Z is one of several listed groups. The reference indicates that these additives impart improved extreme-pressure and antiwear properties to lubricant compositions.

U.S. Pat. No. 3,702,300 discloses carboxy-containing interpolymers in which some of the carboxy groups are esterified and the remaining carboxy groups are neutralized by reaction with a polyamine having one primary or secondary amino group. These interpolymers are described as being useful as additives for use in lubricating compositions and fuels.

SUMMARY OF THE INVENTION

This invention relates to a composition, comprising: (A) an acylated amine having a base number in the range of about 45 to about 90 on an oil free basis, said acylated amine being the product made by contacting (A)(I) at least one carboxylic acid acylating agent with (A)(II) at least one polyamine, said polyamine (A)(II) being selected from the group consisting of (A)(II)(a) a product made by contacting at least one hydroxy material with at least one amine, (A)(II)(b) an alkylene polyamine bottoms product, and (A)(II)(c) a product made by contacting a hydroxy material with an alkylene polyamine bottoms product; (B) a boron compound; and (C) an organic phosphorus acid or ester, or derivative of said phosphorus acid or ester. In one embodiment, this composition further comprises (D) a thiocarbamate. In one embodiment, this composition further comprises (E) a nitrogen-containing ester of a carboxy-containing interpolymer. These compositions are useful as additives for lubricants and functional fluids, and are particularly useful as additives for automatic transmission fluids for enhancing the torque characteristics such automatic transmission fluids.

DESCRIPTION OF THE PREFERRED EMBODIMENTS

As used in this specification and in the appended claims, the term "hydrocarbyl" denotes a group having a carbon atom directly attached to the remainder of the molecule and having a hydrocarbon or predominantly hydrocarbon character within the context of this invention. Such groups include the following:

(1) Hydrocarbon groups; that is, aliphatic, (e.g., alkyl or alkenyl), alicyclic (e.g., cycloalkyl or cycloalkenyl), aromatic, aliphatic- and alicyclic-substituted aromatic, aromatic-substituted aliphatic and alicyclic groups, and the like, as well as cyclic groups wherein the ring is completed through another portion of the molecule (that is, any two indicated substituents may together form an alicyclic group). Such groups are known to those skilled in the art. Examples include methyl, ethyl, octyl, decyl, octadecyl, cyclohexyl, phenyl, etc.

(2) Substituted hydrocarbon groups; that is, groups containing non-hydrocarbon substituents which, in the context of this invention, do not alter the predominantly hydrocarbon character of the group. Those skilled in the art will be aware of suitable substituents. Examples include halo, hydroxy, nitro, cyano, alkoxy, acyl, etc.

(3) Hetero groups; that is, groups which, while predominantly hydrocarbon in character within the context of this invention, contain atoms other than carbon in a chain or ring otherwise composed of carbon atoms. Suitable hetero atoms will be apparent to those skilled in the art and include, for example, nitrogen, oxygen and sulfur.

In general, no more than about three substituents or hetero atoms, and preferably no more than one, will be present for each 10 carbon atoms in the hydrocarbyl group.

Terms such as "alkyl-based," "aryl-based," and the like have meanings analogous to the above with respect to alkyl groups, aryl groups and the like.

The term "hydrocarbon-based" has the same meaning and can be used interchangeably with the term hydrocarbyl when referring to molecular groups having a carbon atom attached directly to the remainder of a molecule.

The term "lower" as used herein in conjunction with terms such as hydrocarbyl, alkyl, alkenyl, alkoxy, and the like, is intended to describe such groups which contain a total of up to 7 carbon atoms.

The term "oil-soluble" refers to a material that is soluble in mineral oil to the extent of at least about one gram per liter at 25° C.

(A) Acylated Amines.

The acylated amines (A) that are useful with the inventive automatic transmission fluids are made by contacting (A)(I) a carboxylic acid acylating agent with (A)(II) a polyamine to provide an acylated amine characterized by a base number in the range of about 45 to about 90, and in one embodiment about 45 to about 70. The term "base number" or "total base number (TBN)" as used herein refers to the amount of acid (perchloric or hydrochloric) needed to neutralize the product (A), excluding diluent oil and unreacted components, expressed as KOH equivalents. KOH equivalents are milligrams of KOH per gram of sample.

(A)(I) (Carboxylic Acid Acylating Agents.

The acylating agents (A)(I) are well known in the art and have been found to be useful as additives for lubricants and fuels and as intermediates for preparing the same. See, for example, the following U.S. Patents which are hereby incorporated by reference for their disclosures relating to carboxylic acid acylating agents: 3,219,666; 3,272,746; 3,381,022; 3,254,025; 3,278,550; 3,288,714; 3,271,310; 3,373,111; 3,346,354; 3,272,743; 3,374,174; 3,307,928; and 3,394,179.

Generally, these carboxylic acid acylating agents are prepared by reacting an olefin polymer or chlorinated analog thereof with an unsaturated carboxylic acid or derivative thereof such as acrylic acid, fumaric acid, maleic anhydride and the like. Often they are polycarboxylic acylating agents such as hydrocarbyl-substituted succinic acids and anhydrides. These acylating agents generally have at least one hydrocarbyl substituent of at least about 8 carbon atoms, and in one embodiment at least about 12 carbon atoms, and in one embodiment at least about 20 carbon atoms, and in one embodiment at least about 30 carbon atoms, and in one embodiment at least about 50 carbon atoms. Generally, this substituent has an average of about 12 or about 20, typically about 30 or about 50 up to about 300 or about 500 carbon atoms; often it has an average of about 50 to about 250 carbon atoms.

The olefin monomers from which the olefin polymers are derived are polymerizable olefins and monomers characterized by having one or more ethylenic unsaturated group. They can be monoolefinic monomers such as ethylene, propylene, butene-1, isobutene and octene-1 or polyolefinic monomers (usually di-olefinic monomers such as butadieneol ,1,3 and isoprene). Usually these monomers are terminal olefins, that is, olefins characterized by the presence of the group $>C=CH_2$. However, certain internal olefins can also serve as monomers (these are sometimes referred to as medial olefins). When such medial olefin monomers are used, they normally are employed in combination with terminal olefins to produce olefin polymers which are interpolymers. Although the hydrocarbyl-based substituents may also include aromatic groups (especially phenyl groups and lower alkyl and/or lower alkoxy-substituted phenyl groups such as para(tertiary butyl)-phenyl groups) and alicyclic groups such as would be obtained from polymerizable cyclic olefins or alicyclic-substituted polymerizable olefins. The olefin polymers are usually free from such groups. Nevertheless, olefin polymers derived from such interpolymers as 1,3-dienes and styrenes or para(tertiary butyl)styrene are exceptions to this general rule.

Generally, the olefin polymers are homo- or interpolymers of terminal hydrocarbyl olefins of about 2 to about 16 carbon atoms. A more typical class of olefin polymers is selected from that group consisting of homo- and interpolymers of terminal olefins of 2 to 6 carbon atoms, especially those of 2 to 4 carbon atoms.

Specific examples of terminal and medial olefin monomers which can be used to prepare the olefin polymers from which the hydrocarbyl substituents are derived include ethylene, propylene, butene-1, butene-2, isobutene, pentene-1, hexene-1, heptene-1, octene-1, nonene-1, decene-1, pentene-2, propylene tetramer, diisobutylene, isobutylene trimer, butadiene-1,3, pentadiene-1,3, isoprene, hexadiene-1,5, 2-chlorobutadiene-1, 3, 2-methylheptene-1, 3-cyclohexylbutene-1, 3,3-dimethylpentene-1, styrenedivinylbenzene, vinylacetate, allyl alcohol, 1-methylvinylacetate, acrylonitrile, ethylacrylate, ethylvinylether and methylvinylketone. Of these, the purely hydrocarbyl monomers are more typical and the terminal olefin monomers are especially typical.

Often the olefin polymers are poly(isobutenes) such as obtained by polymerization of a $C_4$ refinery stream having a butene content of about 35% to about 75% by weight and an isobutene content of about 30% to about 60% by weight in the presence of a Lewis acid catalyst such as aluminum chloride or boron trifluoride. These polyisobutenes usually contain predominantly (that is, greater than 80% of the total repeat units) isobutene repeat units of the configuration

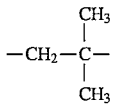

Often the acylating agents (A)(I) are substituted succinic acids or anhydrides which can be represented by the formulae

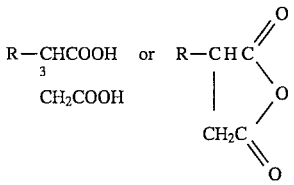

wherein R is a hydrocarbyl group (e.g., alkyl or alkenyl) of about 12 to 500 carbon atoms, and in one embodiment about 30 to about 500 carbon atoms, and in one embodiment about 50 to about 500 carbon atoms.

These succinic acid acylating agents can be made by the reaction of maleic anhydride, maleic acid, or fumaric acid with the aforedescribed olefin polymer, as is shown in the patents cited above. Generally, the reaction involves merely heating the two reactions at a temperature of about 150° C. to about 200° C. Mixtures of the afore-said polymeric olefins, as well as mixtures of unsaturated mono- and dicarboxylic acids can also be used.

In one embodiment the acylating agent (A)(I) is a substituted succinic acid or anhydride, said substituted succinic acid or anhydride consisting of substituent groups and succinic groups wherein the substituent groups are derived from polybutene in which at least about 50% of the total units derived from butenes is derived from isobutylene. The polybutene has an $\overline{M}n$ value of about 800 to about 1200 and an $\overline{M}w/\overline{M}n$ value of about 2 to about 3. The acids or anhydrides are characterized by the presence within their structure of an average of about 0.9 to about 1.2 succinic groups for each equivalent weight of substituent groups. For purposes of this invention, the number of equivalent weights of substituent groups is the number corresponding to the quotient obtained by dividing the $\overline{M}n$ value of the polyalkene from which the substituent is derived into the total weight of the substituent groups present in the substituted succinic acid. Thus, if a substituted succinic acid is characterized by a total weight of substituent group of 40,000 and the $\overline{M}n$ value for the polyalkene from which the substituent groups are derived is 2000, then that substituted succinic acylating agent is characterized by a total of 20(40,000/2000=20) equivalent weights of substituent groups.

(A)(II) Polyamine

The polyamine (A)(II) is selected from the group consisting of (A)(II)(a) a condensed polyamine derived from at least one hydroxy material and at least one amine, (A)(II)(b) an alkylene polyamine bottoms product, or (A)(II)(c) a condensed polyamine derived from at least one hydroxy material and at least one alkylene polyamine bottoms product.

Hydroxy Material Used in Making Condensed Polyamines (A)-(II)(a) and (A)(II)(c)

The hydroxy material used in making (A)(II)(a) or (A)(II)(c) can be any hydroxy material that will condense with the amine reactants referred to above and discussed below. These hydroxy materials can be aliphatic, cycloaliphatic or aromatic alcohols. These alcohols can be monohydric or polyhydric.

The hydroxy materials include alkylene glycols and polyoxyalkylene alcohols such as polyoxyethylene alcohols, polyoxypropylene alcohols, polyoxybutylene alcohols, and the like. These polyoxyalkylene alcohols (sometimes called polyglycols) can contain up to about 150 oxyalkylene groups, with the alkylene group containing from about 2 to about 8 carbon atoms. Such polyoxyalkylene alcohols are generally dihydric alcohols. That is, each end of the molecule terminates with an OH group. In order for such polyoxyalkylene alcohols to be useful, there must be at least one such OH group. However, the remaining OH group can be esterified with a monobasic, aliphatic or aromatic carboxylic acid of up to about 20 carbon atoms such as acetic acid, propionic acid, oleic acid, stearic acid, benzoic acid, and the like. The monoethers of these alkylene glycols and polyoxyalkylene glycols are also useful. These include the monoaryl ethers, monoalkyl ethers, and monoaralkyl ethers of these alkylene glycols and polyoxyalkylene glycols. This group of alcohols can be represented by the formula $$HO\text{-}(\text{-}R^1O\text{-})_pR^2\text{-}OR^3$$

wherein $R^1$ and $R^2$ are independently alkylene groups of from about 2 to 8 carbon atoms; and $R^3$ is aryl (e.g., phenyl), lower alkoxy phenyl, or lower alkyl phenyl, or lower alkyl (e.g., ethyl, propyl, tert-butyl, pentyl, etc.); and aralkyl (e.g., benzyl, phenylethyl, phenylpropyl, p-ethylphenylethyl, etc.); p is from zero to about eight, preferably from about 2 to 4. Polyoxyalkylene glycols where the alkylene groups are ethylene or propylene and p is at least two as well as the monoethers thereof as described above are useful.

The hydroxy materials that are useful include polyhydroxy aromatic compounds, especially the polyhydric phenols and naphthols. These hydroxysubstituted aromatic compounds may contain other substituents in addition to the hydroxy substituents such as halo, alkyl, alkenyl, alkoxy, alkylmercapto, nitro and the like. Usually, the hydroxy aromatic compound will contain from 1 to about 4 hydroxy groups. The aromatic hydroxy compounds are illustrated by the following specific examples: beta-naphthol, alpha-naphthol, cresols, resorcinol, catechol, thymol, eugenol, p,p'-dihydroxy-biphenyl, hydroquinone, pyrogallol, phloroglucinol, hexylresorcinol, 4,4'-methylene-bis-methylene-bisphenol, alpha-decyl-beta-naphthol, the condensation product of heptylphenol with about 0.5 mole of formaldehyde, the condensation product of octylphenol with acetone, di(hydroxyphenyl)oxide, di-(hydroxyphenyl)sulfide, and di(hydroxyphenyl)disulfide.

Examples of monohydric alcohols which can be used include methanol, ethanol, isooctanol, dodecanol, cyclohexanol, cyclopentanol, behenyl alcohol, hexatriacontanol, neopentyl alcohol, isobutyl alcohol, benzyl alcohol, beta-phenylethyl alcohol, 2-methylcyclohexanol, beta-chloroethanol, monomethyl ether of ethylene glycol, monobutyl ether of ethylene.

Other specific alcohols that can be used are the ether alcohols and amino alcohols including, for example, the oxyalkylene-, oxyarylene-, aminoalkylene-, and amino-aryleneosubstituted alcohols having one or more oxyalkylene, aminoalkylene or amino-aryleneoxy-arylene groups. These alcohols are exemplified by the Cellosolves, (products of Union Carbide identified as mono- and dialkyl ethers of ethylene glycol and their derivatives), the Carbitols (products of Union Carbide identified as mono- and dialkyl ethers of diethylene glycol and their derivatives), mono-(heptylphenyl-oxypropylene)-substituted glycerol, poly(styreneoxide), aminoethanol, di(hydroxyethyl)amine, N,N,N',N'-tetrahydroxytrimethylenediamine, and the like.

In one embodiment, the polyhydric alcohols contain from 2 to about 10 hydroxy groups. These are illustrated, for example, by the alkylene glycols and polyoxyalkylene glycols mentioned above such as ethylene glycol, diethylene glycol, triethylene glycol, tetraethylene glycol, dipropylene glycol, tripropylene glycol, dibutylene glycol, tributylene glycol, and other alkylene glycols and polyoxyalkylene glycols in which the alkylene groups contain from 2 to about 8 carbon atoms.

Useful alcohols also include those polyhydric alcohols containing up to about 12 carbon atoms, and especially those containing from about 3 to about 10 carbon atoms. This class of alcohols includes glycerol, erythritol, pentaerythritol, dipentaerythritol, gluconic acid, glyceraldehyde, glucose, arabinose, 1,7-heptanediol, 2,4-heptanediol, 1,2,3-hexanetriol, 1,2,4-hexanetriol, 1,2,5-hexanetriol, 2,3,4-hexanetriol, 1,2,3-butanetriol, 1,2,4-butanetriol, quinic acid, 2,2,6,6-tetrakis-(hydroxymethyl)cyclohexanol, 1,10-decanediol, digitalose, and the like. Aliphatic alcohols containing at least about 3 hydroxyl groups and up to about 10 carbon atoms are useful.

Amino alcohols contemplated as suitable for use as the hydroxy-containing reactant include those amino alcohols having two or more hydroxy groups. Examples of suitable amino alcohols are the N-(N)-(hydroxy-lower alkyl)amines and polyamines such as di-(2-hydroxyethyl)amine, tris(hydroxymethyl)amino methane (THAM), tri-(2-hydroxyethyl)amine, N,N,N'-tri-(2-hydroxyethyl)ethylenediamine, N-(2-hydroxypropyl)-5-carbethoxy-2-piperidone, and ethers thereof with aliphatic alcohols, especially lower alkanols, N,N-di-(3-hydroxypropyl)glycine, and the like. Also contemplated are other poly-N-hydroxyalkyl-substituted alkylene polyamines wherein the alkylene polyamine are as described above; especially those that contain 2 to 3 carbon atoms in the alkylene radicals.

A group of alcohols representative of the above compounds can be represented by the formula $$(R)_n—Y—(X)_q—(AOH)_m$$

wherein R is independently hydrogen or a hydrocarbyl, Y represents S, N, or O; A and X each independently represent an alkylene group; n is 0, 1 or 2 dependent upon m, q, and y where q is 0 or 1 and m is 1, 2, or 3.

Polyoxyalkylene polyols which have two or three hydroxyl groups and contain hydrophobic portions represented by the formula $$-\underset{\underset{R^1}{|}}{CH}CH_2O-$$

wherein $R^1$ is a lower alkyl of up to 3 carbon atoms, and hydrophilic portions containing $—CH_2CH_2O—$ groups are useful. These polyols can be prepared by first reacting a compound of the formula $R^2(OH)_q$ where q is 2 or 3 and $R^2$ is hydrocarbyl with a terminal alkylene oxide of the formula $$R^1—\underset{\diagdown O \diagup}{CH — CH_2}$$

and then reacting that product with ethylene oxide. $R^2(OH)_q$ can be, for example, trimethylolpropane, trimethylolethane, ethylene glycol, trimethylene glycol, tetramethylene glycol, tri-(beta-hydroxypropyl)amine, 1,4-(2hydroxyethyl)cyclohexane, tris-(hydroxymethyl)amino methane, 2-amino-2-methyl- 1,3-propanediol, N,N,N',N'-tetrakis(2-hydroxypropyl)ethylene diamine, N,N,N',N'-tetrakis(2-hydroxyethyl)-ethylene diamine, resorcinol, and the like. The foregoing described $R^2(OH)_q$ polyols may also be used alone as the hydroxy-containing reactant.

Other hydroxy-containing reactants that can be used are hydroxyalkyl, hydroxy alkyl oxyalkyl and hydroxy aryl sulfides of the formula $$S_f(ROH)_{2f}$$

wherein f is 1 or 2, and R is an alkyl of 1 to about 10 carbon atoms or an alkyl oxyalkyl where the alkyl is 1 to about 10 carbon atoms and in one embodiment 2 to about 4 carbon atoms, and aryl is at least 6 carbon atoms. Examples include 2,2'-thiodiethanol and 2,2'-thiodipropanol.

Amines Useful in Making the Polyamines (A)(II)(a).

The amines useful in making the polyamines (A)(II)(a) include primary amines and secondary amines. These amines are characterized by the presence within their structure of at least one H-N< group and/or at least one $—NH_2$ group. These amines can be monoamines or polyamines, with the polyamines being preferred. Mixtures of two or more amines can be used.

The amines can be aliphatic, cycloaliphatic, aromatic or heterocyclic, including aliphatic-substituted aromatic, aliphatic-substituted cycloaliphatic, aliphatic-substituted heterocyclic, cycloaliphatic-substituted aliphatic, cycloaliphaticsubstituted aromatic, cycloaliphatic-substituted heterocyclic, aromatic-substituted aliphatic, aromatic-substituted cycloaliphatic, aromatic-substituted heterocyclic, heterocyclic-substituted aliphatic, heterocyclic-substituted cycloaliphatic and heterocyclic-substituted aromatic amines. These amines may be saturated or unsaturated. If unsaturated, the amine is preferably free from acetylenic unsaturation. The amines may also contain non-hydrocarbon substituents or groups as long as these groups do not significantly interfere with the reaction of the amines with the hydroxy materials used in making the condensed polyamines (A)(II)(a). Such non-hydrocarbon substituents or groups include lower alkoxy, lower alkyl, mercapto, nitro, and interrupting groups such as —O— and —S— (e.g., as in such groups as $—CH_2CH_2—X— CH_2C_2—$ where X is —O— or —S—).

With the exception of the branched polyalkylene polyamines, the polyoxyalkylene polyamines and the high molecular weight hydrocarbyl-substituted amines described more fully hereinafter, the amines used in this invention ordinarily contain less than about 40 carbon atoms in total and usually not more than about 20 carbon atoms in total.

Aliphatic monoamines include mono-aliphatic and di-aliphatic-substituted amines wherein the aliphatic groups can be saturated or unsaturated and straight or branched chain. Thus, they are primary or secondary aliphatic amines. Such amines include, for example, mono- and di-alkyl-substituted amines, mono- and di-alkenyl-substituted amines, and amines having one N-alkenyl substituent and one N-alkyl substituent, and the like. The total number of carbon atoms in these aliphatic monoamines preferably does not exceed about 40 and usually does not exceed about 20 carbon atoms. Specific examples of such monoamines include ethylamine, di-ethylamine, n-butylamine, di-n-butylamine, allylamine, isobutylamine, cocoamine, stearylamine, laurylamine, methyllaurylamine, oleylamine, N-methyl-octylamine, dodecylamine, octadecylamine, and the like. Examples of cycloaliphatic-substituted aliphatic amines, aromatic-substituted aliphatic amines, and heterocyclic-substituted aliphatic amines, include 2-(cyclohexyl)-ethylamine, benzylamine, phenylethylamine, and 3-(furylpropyl) amine.

Examples of useful polyamines include N-aminopropyl-cyclo-hexylamine, N-N'-di-n-butyl-para-phenylene diamine, bis-(para-aminophenyl)methane, 1,4-diaminocyclohexane, and the like.

Heterocyclic monoamines and polyamines can be used. As used herein, the terminology "heterocyclic mono- and polyamine(s)" is intended to describe those heterocyclic amines containing at least one primary or secondary amino group and at least one nitrogen as a heteroatom in the heterocyclic ring. These heterocyclic amines can be saturated or unsaturated and can contain various substituents such as nitro, alkoxy, alkyl mercapto, alkyl, alkenyl, aryl, alkaryl, or aralkyl substituents. Generally, the total number of carbon atoms in the substituents will not exceed about 20. Heterocyclic amines can contain more than one nitrogen, oxygen, phosphrous, sulfur heteroatom. The 5- and 6-membered heterocyclic rings are preferred.

Among the suitable heterocyclics are aziridines, azetidines, azolidines, tetra- and di-hydropyridines, pyrroles, indoles, piperadines, imidazoles, di- and tetra-hydroimidazoles, piperazines, isoindoles, purines, morpholines, thiomorpholines, N-aminoalkyl-morpholines, N-aminoalkylthio-morpholines, N-aminoalkyl-piperazines, N,N'-diaminoalkylpiperazines, azepines, azocines, azonines, azecines and tetra-, di- and perhydroderivatives of each of the above and mixtures of two or more of these heterocyclic amines. Preferred heterocyclic amines are the saturated 5- and 6-membered heterocyclic amines containing only nitrogen, oxygen and/or sulfur in the hetero ring, especially the piperidines, piperazines, thiomorpholines, morpholines, pyrrolidines, and the like. Piperidine, aminoalkyl-substituted piperidines, piperazine, aminoalkyl-substituted piperazines, morpholine, aminoalkyl-substituted morpholines, pyrrolidine, and aminoalkyl-substituted pyrrolidines, are useful. Usually the aminoalkyl substituents are substituted on a nitrogen atom forming part of the hetero ring. Specific examples of such heterocyclic amines include N-aminopropylmorpholine, N-aminoethylpiperazine, and N,N'-di-aminoethylpiperazine.

Also suitable as amines are the aminosulfonic acids and derivatives thereof corresponding to the formula:

$$(R^1R^2N)_xR^3(S_{3/4}R)_y$$

wherein R is OH, $NH_2$, $ONH_4$, etc.; $R^3$ is a polyvalent organic group having a valence equal to x+y; $R^1$ and $R^2$ are each independently hydrogen, hydrocarbyl or substituted hydrocarbyl with the proviso that at least one of $R^1$ and $R^2$ is hydrogen; x and y are each integers equal to or greater than one. Each aminosulfonic reactant is characterized by at least one HN< or $H_2N$— group and at least one $$-\overset{\overset{\displaystyle O}{\|}}{\underset{\underset{\displaystyle O}{\|}}{S}}-R$$

group. These sulfonic acids can be aliphatic, cycloaliphatic or aromatic aminosulfonic acids and the corresponding functional derivatives of the sulfo group. Specifically, the aminosulfonic acids can be aromatic aminosulfonic acids, that is, where $R^3$ is a polyvalent aromatic group such as phenylene where at least one $$-\overset{\overset{\displaystyle O}{\|}}{\underset{\underset{\displaystyle O}{\|}}{S}}-R$$

group is attached directly to a nuclear carbon atom of the aromatic group. The aminosulfonic acid may also be a mono-amino aliphatic sulfonic acid; that is, an acid where x is one and $R^3$ is a polyvalent aliphatic group such as ethylene, propylene, trimethylene, and 2-methylene propylene. Other suitable aminosulfonic acids and derivatives thereof useful as amines in this invention are disclosed in U.S. Pat. Nos. 3,029,250; 3,367,864; and 3,926,820; which are incorporated herein by reference.

The high molecular weight hydrocarbyl polyamines which can be used as amines in this invention are generally prepared by reacting a chlorinated polyolefin having a molecular weight of at least about 400 with ammonia or an amine. The amines that can be used are known in the art and described, for example, in U.S. Pat. Nos. 3,275,554 and 3,438,757, both of which are incorporated herein by reference. These amines must possess at least one primary or secondary amino group.

Another group of amines suitable for use in this invention are branched polyalkylene polyamines. The branched polyalkylene polyamines are polyalkylene polyamines wherein the branched group is a side chain containing on the average at least one nitrogen-bonded aminoalkylene $$\text{(i.e., } NH_2-R-\overset{\overset{\displaystyle H}{|}}{N}-R_x-\text{)}$$

group per nine amino units present on the main chain; for example, 1–4 of such branched chains per nine units on the main chain, but preferably one side chain unit per nine main chain units. Thus, these polyamines contain at least three primary amino groups and at least one tertiary amino group. U.S. Pat. Nos. 3,200,106 and 3,259,578 are incorporated herein by reference for their disclosures relative to said polyamines.

Suitable amines also include polyoxyalkylene polyamines, e.g., polyoxyalkylene diamines and polyoxyalkylene triamines, having average molecular weights ranging from about 200 to about 4000, and in one embodiment from about 400 to 2000. Examples of these polyoxyalkylene polyamines include those amines represented by the formula:

$$NH_2\text{-Alkylene-(—O—Alkylene—)}_mNH_2$$

wherein m has a value of from about 3 to about 70, and in one embodiment from about 10 to about 35; and the formula:

$$R\text{-[Alkylene-(—O—Alkylene—)}_nNH_2]_{3-6}$$

wherein n is a number in the range of from 1 to about 40, with the proviso that the sum of all of the n's is from about 3 to about 70 and generally from about 6 to about 35, and R is a polyvalent saturated hydrocarbyl group of up to about 10 carbon atoms having a valence of from about 3 to about 6. The alkylene groups may be straight or branched chains and contain from 1 to about 7 carbon atoms, and usually from I to about 4 carbon atoms. The various alkylene groups present within the above formulae may be the same or different.

Useful polyoxyalkylene polyamines include the polyoxyethylene and polyoxypropylene diamines and the polyoxypropylene triamines having average molecular weights ranging from about 200 to about 2000. The polyoxyalkylene polyamines are commercially available from the Jefferson Chemical Company, Inc. under the trade name "Jeffamine." U.S. Pat. Nos. 3,804,763 and 3,948,800 are incorporated herein by reference for their disclosure of such polyoxyalkylene polyamines.

Useful amines are the alkylene polyamines conforming to the formula:

$$H-\underset{\underset{\displaystyle R}{|}}{N}-(\text{Alkylene}-\underset{\underset{\displaystyle R}{|}}{N})_nR$$

wherein n is from I to about 10; each R is independently a hydrogen atom, a hydrocarbyl group or a hydroxy-substituted hydrocarbyl group having up to about 700 carbon atoms, and in one embodiment up to about 100 carbon atoms, and in one embodiment up to about 30 carbon atoms; and the "Alkylene" group has from about 1 to about 10 carbon atoms with the preferred alkylene being ethylene or propylene. Useful are the alkylene polyamines wherein each R is hydrogen with the ethylene polyamines, and mixtures of ethylene polyamines being particularly preferred. Usually n will have an average value of from about 2 to about 7. Such alkylene polyamines include methylene polyamines, ethylene polyamines, butylene polyamines, propylene polyamines, pentylene polyamines, hexylene polyamines, heptylene polyamines, etc. The higher homologs of such amines and related aminoalkyl-substituted piperazines are also included.

Alkylene polyamines that are useful include ethylene diamine, triethylene tetramine, propylene diamine, trimethylene diamine, hexamethylene diamine, decamethylene diamine, octamethylene diamine, di(heptamethylene) triamine, tripropylene tetramine, tetraethylene pentamine, trimethylene diamine, pentaethylene hexamine, di(trimethylene) triamine, N-(2-aminoethyl) piperazine, 1,4-bis(2-aminoethyl) piperazine, and the like. Higher homologs as are obtained by condensing two or more of the above-illustrated alkylene amines are useful as amines in this invention as are mixtures of two or more of any of the aforedescribed polyamines.

Ethylene polyamines, such as those mentioned above, are described in detail under the heading "Diamines and Higher Amines" in The Encyclopedia of Chemical Technology, Second Edition, Kirk and Othmer, Volume 7, pages 27–39, Interscience Publishers, Division of John Wiley and Sons, 1965, these pages being incorporated herein by reference. Such compounds are prepared most conveniently by the reaction of an alkylene chloride with ammonia or by reaction of an ethylene imine with a ring-opening reagent such as ammonia, etc. These reactions result in the production of the somewhat complex mixtures of alkylene polyamines, including cyclic condensation products such as piperazines.

A useful class of polyamines that can be used are those represented by the formula $$H-\underset{\underset{R}{|}}{N}-(Z-NR')_x-R$$

in which each R is hydrogen or a hydrocarbyl group; each R' is independently hydrogen, alkyl, or $NH_2R''(NR'')_y$— where each R' is independently an alkylene group of 1 to about 10 carbon atoms and y is a number in the range of from 1 to about 6; each Z is independently an alkylene group of 1 to about 10 carbon atoms, a heterocyclic nitrogen containing cycloalkylene or an oxyalkylene group of I to about 10 carbon atoms and x is a number in the range of from I to about 10.

Polyamine Bottoms Useful as Polyamines (A)(II)(b) or in Making Condensed Polyamines (A)(II)(c).

The polyamine bottoms that can be used as either the polyamines (A)(II)(b) or in making the condensed polyamines (A)(II)(c) are polyamine mixtures resulting from stripping of the alkylene polyamine mixtures discussed above. Lower molecular weight polyamines and volatile contaminates are removed from an alkylene polyamine mixture to leave as residue what is often termed "polyamine bottoms." In general, alkylene polyamine bottoms can be characterized as having less than 2%, usually less than 1% by weight material boiling below about 200° C. In the instance of ethylene polyamine bottoms, the bottoms contain less than about 2% by weight total diethylene triamine (DETA) or triethylene tetramine (TETA). A typical sample of such ethylene polyamine bottoms obtained from the Dow Chemical Company of Freeport, Tex. designated "E-100" showed a specific gravity at 15.6° C. of 1.0168, a percent nitrogen by weight of 33.15 and a viscosity at 40° C. of 121 centistokes. Gas chromatography analysis of such a sample showed it to contain about 0.93% "Light Ends" (DETA), 0.72% TETA, 21.74% tetraethylene pentamine and 76.61% pentaethylene hexamine and higher (by weight). These alkylene polyamine bottoms include cyclic condensation products such as piperazine and higher analogs of diethylene triamine, triethylene tetramine and the like.

Process for Making the Condensed Polyamines (A)(II)(a) and (A)(II)(c).

The reaction between the hydroxy material and the amine to form the condensed polyamines (A)(II)(a) and (A)(II)(c) requires the presence of an acid catalyst. The catalysts that are useful include mineral acids (mono, di- and polybasic acids) such as sulfuric acid and phosphoric acid; organo phosphorus acids and organo sulfonic acids such as $RP(O)(OH)_2$ and $RSO_3H$, wherein R is hydrocarbyl; alkali metal partial salts of $H_3PO_4$ and $H_2SO_4$, such as $NaHSO_4$, $LiHSO_4$, $KHSO_4$, $NaH_2PO_4$, $LiH_2PO_4$ and $KH_2PO_4$; alkaline earth metal partial salts of $H_3PO_4$ and $H_2SO_4$, such as $CaHPO_4$, $NaHSO_4$ and Mg $HPO_4$; also $Al_2O_3$ and Zeolites. Phosphoric acid is useful because of its commercial availability and ease of handling. Also useful as catalysts for this invention are materials which generate acids when treated in the reaction mixture, e.g., triphenylphosphite.

The reaction is run at an elevated temperature which, depending upon the particular reactants, can range from about 60° C. to about 265° C. Most reactions, however, are run in the range of about 220° C. to about 250° C. The reaction may be run at atmospheric pressure or optionally at a elevated pressure depending upon the particular reactants. The degree of condensation of the resultant polyamine is limited only to the extent necessary to prevent the formation of solid products under reaction conditions. The control of the degree of condensation of the product is normally accomplished by limiting the amount of the condensing agent, i.e., the hydroxy material, charged to the reaction medium. In one embodiment, the condensed polyamines are pourable at room temperature and have viscosities which range from about 100% greater than the viscosity of the amine reactant to about 6000% greater than the viscosity of the amine reactant. In one embodiment, the condensed polyamines have viscosities which range from about 50% to about 1000% greater than the viscosity of the amine reactant. In one embodiment, the viscosity of the condensed polyamines ranges from about 50 cSt to about 200 cSt at 100° C.

Process for Making the Acylated Amine (A).

The carboxylic acid acylating agents (A)(I) can be reacted with the polyamines (A)(II) according to conventional amide, imide or amidine forming techniques to form the acylated amines (A). This normally involves heating the acylating agent (A) with the polyamine (A)(II), optionally in the presence of a normally liquid, substantially inert, organic liquid sol-vent/diluent. Temperatures of at least about 30° C. up to the decomposition temperature of the reaction component and/or product having the lowest such temperature can be used. This temperature usually is in the range of about 80° C. to about 250° C.

The relative proportions of the acylating agent (A)(I) and the polyamine (A)(II) to be used in the above process are such that at least about one-half of a stoichiometrically equivalent amount of the polyamine (A)(II) is used for each equivalent of the acylating agent (A)(I) used. In this regard it will be noted that the equivalent weight of the polyamine (A)(II) is based upon the number of the nitrogen-containing groups defined by the structural configuration

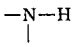

Similarly the equivalent weight of the acylating agent (A)(I) is based upon the number of the acid-producing groups defined by the structural configuration

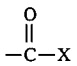

Thus, ethylene diamine has two equivalents per mole; amino guanidine has four equivalents per mole; a succinic acid or ester has two equivalents per mole, etc. The upper limit of the useful amount of the polyamine (A)(II) appears to be about two moles for each equivalent of the acylating agent (A)(I) used. Such amount is required, for instance, in the formation of products having predominantly amidine linkages. Beyond this limit, the excess amount of the polyamine (A)(II) appears not to take part in the reaction. On the other hand, the lower limit of about one-half equivalent of the polyamine (A)(II) used for each equivalent of the acylating agent (A)(I) is based upon the stoichiometry for the formation of products having predominantly imide linkages. In most instances, the amount of the polyamine (A)(II) is approximately one and one-half equivalent for each equivalent of the acylating agent (A)(I) used.

In one embodiment, the acylated amines (A) are prepared in the same manner as the polyamines (A)(II) of the present invention. That is, they are prepared by the acid catalyzed condensation reaction of at least one carboxylic acylating agent (A)(I) with at least one polyamine (A)(II). The catalysts previously described with respect to the polyamines (A)(II) are useful in this reaction.

The acylated amines (A) generally have a total base number (TBN) in the range of about 45 to about 90, and in one embodiment about 55 to about 80.

The following examples are illustrative of the preparation of acylated amines (A) that are useful with this invention. In the following example, as well as throughout the specification and in the claims, unless otherwise indicated, all parts and percentages are by weight, all temperatures are in degrees Celsius, and all pressures are at or near atmospheric.

EXAMPLE A-1

Part I

A mixture of 76.4 parts by weight of HPA-X (a product of Union Carbide identified as a polyamine bottoms product having a nitrogen content of 31.5% by weight and an average base number of 1180) and 46.7 parts by weight of THAM (trishydroxymethyl aminomethane) are heated at a temperature of 220° C. under condensation reaction conditions in the presence of 1.25 parts by weight of an 85% by weight phosphoric acid aqueous solution to form a condensed polyamine. 1.7 parts by weight a 50% aqueous solution of NaOH are then added to the reaction mixture to neutralize the phosphoric acid. The resulting product is a condensed polyamine having the following properties: viscosity at 40° C. of 6500 cSt; viscosity at 100° C. of 90 cSt; total base number of 730; and nitrogen content of 27% by weight.

Part II

A mixture of 1000 parts by weight of polyisobutenyl (Mn =1000) succinic anhydride and 400 parts by weight of diluent oil are charged to a reactor while mixing under a $N_2$ purge. The batch temperature is adjusted to 88° C. 152 parts by weight of the condensed polyamine from Part I are charged to the reactor while maintaining the reactor temperature at 88°–93° C. The molar ratio of acid to nitrogen is 1 COOH: 1.55N. The batch is mixed for two hours at 82°–96° C., then heated to 152° C. over 5.5 hours. The $N_2$ purge is discontinued and submerged $N_2$ blowing is begun. The batch is blown to a water content of 0.30% by weight or less at 149°–154° C., cooled to 138°–149° C. and filtered. Diluent oil is added to provide an oil content of 40% by weight. The resulting product has a nitrogen content of 2.15% by weight, a viscosity at 100° C. of 210 cSt, and a total base number of 48.

EXAMPLE A-2

A mixture of 108 parts by weight of a polyamine mixture (15 % by weight diethylene triamine and 85% by weight polyamine bottoms) and 698 parts by weight diluent oil is charged to a reactor. 1000 parts by weight of polyisobutenyl ($\overline{M}n$=1000) succinic anhydride are charged to the reactor under a $N_2$ purge while maintaining the batch temperature at 110°–121° C. 121° C. The molar ratio of acid to nitrogen is 1 COOH: 1.5N. After neutralization submerged $N_2$ blowing is begun. The batch is heated to 143°–149° C., and then filtered. Diluent oil is added to provide an oil content of 40% by weight. The resulting product has a nitrogen content of 2.0% by weight, a viscosity at 100° C. of 135–155 cSt, and a total base number of 55.

(B) Boron Compound

The boron compound can be an inorganic or an organic compound. The inorganic compounds include the boron acids, anhydrides, oxides and halides. The organic boron compounds include the boron amides and esters. Also included are the borated acylated amines of (A) as well other borated acylated amines and borated dispersants, borated epoxides and the borated fatty acid esters of glycerol.

The boron compounds that are useful include boron oxide, boron oxide hydrate, boron trioxide, boron trifluoride, boron tribromide, boron trichloride, boron acids such as boronic acid (i.e., alkyl-$B(OH)_2$ or aryl-$B(OH)_2$), boric acid (i.e., $H_3BO_3$), tetraboric acid (i.e., $H_2B_4O_7$), metaboric acid (i.e., $HBO_2$), boron anhydrides, boron amides and various esters of such boron acids. Complexes of boron trihalide with ethers, organic acids, inorganic acids, or hydrocarbons can be used. Examples of such complexes include boron-trifluoride-triethyl ester, boron trifluoride-phosphoric acid, boron trichloride-chloroacetic acid, boron tribromide-dioxane, and boron trifluoridemethyl ethyl ether.

Specific examples of boronic acids include methyl boronic acid, phenyl-boronic acid, cyclohexyl boronic acid, p-heptylphenyl boronic acid and dodecyl boronic acid.

The boron acid esters include mono-, di-, and tri-organic esters of boric acid with alcohols or phenols such as, e.g., methanol, ethanol, isopropanol, cyclohexanol, cyclopentanol, 1-octanol, 2-octanol, dodecanol, behenyl alcohol, oleyl alcohol, stearyl alcohol, benzyl alcohol, 2-butyl cyclohexanol, ethylene glycol, propylene glycol, trimethylene glycol, 1,3-butanediol, 2,4-hexanediol, 1,2-cyclohexanediol, 1,3-octanediol, glycerol, pentaerythritol diethylene glycol, carbitol, Cellosolve, triethylene glycol, tripropylene glycol, phenol, naphthol, p-butylphenol, o,p-diheptyl-phenol, n-cyclohexylphenol, 2,2-bis-(p-hydroxyphenyl)-propane, polyiso-butene (molecular weight of 1500)-substituted phenol, ethylene chlorohydrin, o-chlorophenol, m-nitrophenol, 6-bromooctanol, and 7-keto-decanol. Lower alcohols, 1,2-glycols, and 1–3-glycols, i.e., those having less than about 8 carbon atoms are especially useful for preparing the boric acid esters for the purpose of this invention.

Methods for preparing the esters of boron acid are known and disclosed in the art (such as "Chemical Reviews," pp. 959–1064, Vol. 56). Thus, one method involves the reaction of boron trichloride with 3 moles of an alcohol or a phenol to result in a tri-organic borate. Another method involves the reaction of boric oxide with an alcohol or a phenol. Another method involves the direct esterification of tetra boric acid with 3 moles of an alcohol or a phenol. Still another method involves the direct esterification of boric acid with a glycol to form, e.g., a cyclic alkylene borate.

Borated Acylated Amines

The borated acylated amines can be prepared by first reacting a carboxylic acid acylating agent with at least about one-half equivalent, per equivalent of carboxylic acid acylating agent, of an amine containing at least one hydrogen attached to a nitrogen group. The acylated amine obtained in this manner is usually a complex mixture of acylated amines. The acylated amine is then borated by reacting it with a boron compound of the type described above, including the boron trioxides, boron halides, boron acids, boron amides, and esters of boron acids.

The acylated amines that can be used are described above under the subtitle "(A) Acylated Amines". Additional acylated amines that can be used are described in the following U.S. Pat. Nos.:

| |
|---|
| 3,087,936 |
| 3,172,892 |
| 3,215,707 |
| 3,254,025 |
| 3,272,746 |
| 3,316,177 |
| 3,341,542 |
| 3,346,493 |
| 3,444,170 |
| 3,454,607 |
| 3,541,012 |
| 3,630,904 |
| 3,632,511 |
| 3,787,374 |
| 4,234,435 |

The above U.S. patents are expressly incorporated herein by reference for their teaching of the preparation of acylated amines that are useful herein.

The amount of boron compound reacted with the acylated amine intermediate generally is sufficient to provide from about 0.1 atomic proportion of boron for each mole of the acylated amine up to about 10 atomic proportions of boron for each atomic proportion of nitrogen of said acylated amine. More generally the amount of boron compound present is sufficient to provide from about 0.5 atomic proportion of boron for each mole of the acylated amine to about 2 atomic proportions of boron for each atomic proportion of nitrogen used.

The reaction of the acylated amine with the boron compound can be effected simply by mixing the reactants at the desired temperature. The use of an inert solvent is optional although it is often desirable, especially when a highly viscous or solid reactant is present in the reaction mixture. The inert solvent may be a hydrocarbon such as benzene, toluene, naphtha, cyclohexane, n-hexane, or mineral oil. The temperature of the reaction may be varied within wide ranges. Ordinarily it is preferably between about 50° C. and about 250° C. In some instances it may be 25° C. or even lower. The upper limit of the temperature is the decomposition point of the particular reaction mixture and/or product.

The reaction is usually complete within a short period such as 0.5 to 6 hours. After the reaction is complete, the product may be dissolved in the solvent and the resulting solution purified by centrifugation or filtration if it appears to be hazy or contain insoluble substances. Ordinarily the product is sufficiently pure so that further purification is unnecessary or optional.

Borated Epoxides

The borated epoxides are made by reacting at least one of boric acid or boron trioxide with at least one epoxide having the formula

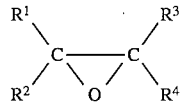

wherein each of $R^1$, $R^2$, $R^3$ and $R^4$ is hydrogen or an aliphatic group, or any two thereof together with the epoxy carbon atom or atoms to which they are attached form a cyclic group. The epoxide contains at least 8 carbon atoms. In one embodiment this reaction is conducted in the presence of a minor amount of a heel of a previously obtained oil-soluble boron-containing composition prepared by reacting the foregoing reagents.

The boric acid that can be used can be any of the various forms of boric acid, including metaboric acid ($HBO_2$), orthoboric acid ($H_3BO_3$) and tetraboric acid ($H_2B_4O_7$). Boric acid and orthoboric acid are preferred.

Each of the R groups in the above formula are most often hydrogen or an aliphatic group with at least one being an aliphatic group containing at least 6 carbon atoms. The term "aliphatic group" includes aliphatic hydrocarbon groups (e.g., hexyl, heptyl, octyl, decyl, dodecyl, tetradecyl, stearyl, hexenyl, oleyl), preferably free from acetylenic unsaturation; substituted aliphatic hydrocarbon groups including substituents such as hydroxy, nitro, carbalkoxy, alkoxy and alkylthio (especially those containing a lower alkyl group; i.e., one containing 7 carbon atoms or less); and hetero atom-containing groups in which the hetero atoms may be, for example, oxygen, nitrogen or sulfur. The aliphatic groups are generally alkyl groups, and in one embodiment those containing from about 10 to about 20 carbon atoms. It is within the scope of the invention to use commercial mixtures of epoxides; for example, commercial mixtures of $C_{14-16}$ or $C_{14-18}$ epoxides and the like, wherein $R^1$ is a mixture of alkyl radicals having two less carbon atoms than the epoxide.

In one embodiment the borated epoxide is a borated alpha-olefin epoxide having about 10 to about 20 carbon atoms, and in one embodiment about 14 to about 18 carbon atoms.

Also within the scope of the invention is the use of epoxides in which any two of the R groups together with the epoxy carbon atom or atoms to which they are attached, form a cyclic group, which may be alicyclic or heterocyclic. Examples include n-butylcyclopentene oxide, n-hexylcyclohexene oxide, methylenecyclooctene oxide and 2-methylene-3-n-hexyltetrahydrofuran oxide.

The borated epoxides may be prepared by merely blending the boric acid or boron trioxide and the epoxide and heating them at a temperature from about 80° C. to about 250° C., and in one embodiment from about 100° C. to about 200° C., for a period of time sufficient for reaction to take place. If desired, the reaction may be effected in the presence of a substantially inert, normally liquid organic diluent such as toluene, xylene, chlorobenzene, dimethylformamide or the like, but such diluents are usually unnecessary. During the reaction, water is frequently evolved and may be removed by distillation.

The molar ratio of the boric acid or boron trioxide to the epoxide is generally between about 1:0.25 and about 1:4. Ratios between about 1:1 and about 1:3 are useful.

In one embodiment it is advantageous to employ a catalytic amount of an alkaline reagent to facilitate the reaction. Suitable alkaline reagents include inorganic bases and basic salts such as sodium hydroxide, potassium hydroxide and sodium carbonate; metal alkoxides such as sodium methoxide, potassium t-butoxide and calcium ethoxide; heterocyclic amines such as piperidine, morpholine and pyridine; and aliphatic amines such as n-butylamine, di-n-hexylamine and tri-n-butylamine. Useful alkaline reagents are the aliphatic and heterocyclic amines and especially tertiary amines.

The preparation of a borated epoxide useful in this invention is illustrated by the following example.

EXAMPLE B-1

Part I

A mixture of 1500 parts (6.25 moles) of 1-hexadecene oxide and 1 part of tri-n-butylamine is heated to 100°–110° C. under nitrogen, with stirring. Boric acid, 193 parts (3.13 moles), is added incrementally over 15 minutes. When boric acid addition is complete, the reaction mixture is heated to 185° C. as water is removed by distillation. When water evolution ceases, the mixture is filtered while hot, and the filtrate is allowed to cool to a waxy solid melting at 60°–65° C. This solid is the desired product; it contains 2.7 % boron.

Part II

A blend of 193 parts (3.13 moles) of boric acid, 1 part of tri-n-butylamine and a "heel" comprising 402 parts of the product prepared as in Part I is heated to 188° C., with stirring, as volatiles are removed by distillation. After 8.5 hours, 1500 parts (6.25 moles) of 1-hexadecene oxide is added over 5.5 hours at 186°–195° C., with stirring. Heating and stirring are continued for 2 hours as volatiles are removed. The material is then vacuum stripped and filtered at 93°–99° C. The filtrate is the desired product; it contains 2.1% boron.

Borated Fatty Acid Esters of Glycerol

The borated fatty acid esters of glycerol are prepared by reacting a fatty acid ester of glycerol with a boric acid (e.g., boric acid, metaboric acid, orthoboric acid, tetraboric acid) with removal of the water of reaction, In one embodiment there is sufficient boron present such that each boron will react with from about 1.5 to about 2.5 hydroxyl groups present in the reaction mixture.

The reaction may be carried out at a temperature in the range of about 60° C. to about 135° C., in the absence or presence of any suitable organic solvent such as methanol, benzene, xylenes, toluene, neutral oil and the like.

Fatty acid esters of glycerol can be prepared by a variety of methods well known in the art. Many of these esters, such as glycerol monooleate and glycerol tallowate, are manufactured on a commercial scale. The esters useful for this invention are oil-soluble and are preferably prepared from $C_8$ to $C_{22}$ fatty acids or mixtures thereof such as are found in natural products. The fatty acid may be saturated or unsaturated. Certain compounds found in acids from natural sources may include licanic acid which contains one keto group. Useful $C_8$ to $C_{22}$ fatty acids are those of the formula R-COOH wherein R is alkyl or alkenyl.

The fatty acid monoester of glycerol is useful. Mixtures of mono and diesters may be used. Mixtures of mono- and diester can contain at least about 40% of the monoester. Mixtures of mono- and diesters of glycerol containing from about 40% to about 60% by weight of the monoester can be used. For example, commercial glycerol monooleate containing a mixture of from 45% to 55% by weight monoester and from 55% to 45% diester can be used.

Useful fatty acids are oleic, stearic, isostearic, palmitic, myristic, palmitoleic, linoleic, lauric, linolenic, and eleostearic, and the acids from the natural products tallow, palm oil, olive oil, peanut oil, corn oil, neat's foot oil and the like can be used.

Useful borated fatty acid esters of glycerol include borated glycerol monooleate, borated lecithin, borated tallow, and borated di(hydroxo-yethyl) tallow amine.

(C) Organic Phosphorus Acid, Ester or Derivative

The organic phosphorus acid, ester or derivative (C) can be an organic phosphorus acid, organic phosphorus acid ester, organic phosphorus acid salt, or derivative thereof. The organic phosphorus acids include the phosphonic, phosphinic, and thiophosphoric acids thiophosphinic and thiophosphonic acids.

The phosphorus acids can be represented by the formula

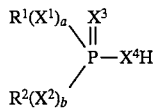

(C-I)

wherein $X^1$, $X^2$, $X^3$ and $X^4$ are independently O or S, and $X^1$ and $X^2$ can be $NR^3$ wherein $R^3$ is hydrogen or a hydrocarbyl group, preferably hydrogen or a lower alkyl group; a and b are independently zero or one, and $R^1$ and $R^2$ are independently hydrocarbyl groups. These phosphorus acids include the phosphorus- and sulfur-containing acids. They include those acids wherein at least one $X^3$ or $X^4$ is sulfur, and more preferably both $X^3$ and $X^4$ are sulfur, at least one $X^1$ or $X^2$ is oxygen or sulfur, more preferably both $X^1$ and $X^2$ are oxygen, and a and b are each 1.

The phosphorus acids can be at least one phosphate, phosphonate, phosphinate or phosphine oxide. These pentavalent phosphorus derivatives can be represented by the formula

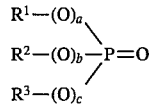

(C-II)

wherein $R^1$, $R_2$ and $R^3$ are independently hydrogen or hydrocarbyl groups, with the proviso that at least one of $R^1$, $R^2$ or $R^3$ is hydrocarbyl, and a, b and c are independently zero or 1.

The phosphorus acid can be at least one phosphite, phosphonite, phosphinite or phosphine. These trivalent phosphorus derivatives can be represented by the formula

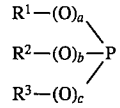

(C-III)

wherein $R^1$, $R^2$ and $R^3$ are independently hydrogen or hydrocarbyl groups, with the proviso that at least one of $R^1$, $R^2$ or $R^3$ is hydrocarbyl, and a, b and c are independently zero or 1.

The total number of carbon atoms in the R groups in each of the above formulae (C-I), (C-II) and (C-III) must be sufficient to render the compound oil-soluble. Generally, the total number of carbon atoms in the R groups is at least about 8, and in one embodiment at least about 12, and in one embodiment at least about 16. There is no limit to the total number of carbon atoms in the R groups that is required, but a practical upper limit is about 400 or about 500 carbon atoms. In one embodiment, each of the R groups in the above formulae are independently hydrogen or hydrocarbyl groups of 1 to about 100 carbon atoms, or 1 to about 50 carbon atoms, or 1 to about 30 carbon atoms, with the proviso that at least one of the R groups is hydrocarbyl and the total number of carbons is at least about 8. Each of the R groups can be the same as the other, although they may be different. Examples of useful R groups include t-butyl, isobutyl, amyl, isooctyl, decyl, dodecyl, eicosyl, 2-pentenyl, dodecenyl, phenyl, naphthyl, alkylphenyl, alkylnaphthyl, phenylalkyl, naphthylalkyl, alkylphenylalkyl, alkylnaphthylalkyl, and the like.

The phosphorus acid esters can be prepared by reacting a phosphorus acid or anhydride with an alcohol containing from 1 or about 3 carbon atoms up to about 30, or about 24, or about 12 carbon atoms. The phosphorus acid or anhydride is generally an inorganic phosphorus reagent such as phosphorus pentoxide, phosphorus trioxide, phosphorus tetraoxide, phosphorus acid, phosphorus halide, or lower phosphorus esters, and the like. Lower phosphorus acid esters contain from 1 to about 7 carbon atoms in each ester group. The phosphorus acid ester may be a mono, di- or triphosphoric acid ester.

Alcohols used to prepare the phosphorus acid esters include butyl, amyl, hexyl, octyl, oleyl, and cresol alcohols, Higher synthetic monohydric alcohols of the type formed by Oxo process (e.g., 2-ethylhexyl), the Aldol condensation, or by organo aluminum catalyzed oligomerization of alpha-olefins (especially ethylene), followed by oxidation and hydrolysis, also are useful. Examples of some preferred monohydric alcohols and alcohol mixtures include the commercially available "Alfol" alcohols marketed by Continental Oil Corporation. Alfol 810 is a mixture of alcohols containing primarily straight chain, primary alcohols having from 8 to 10 carbon atoms. Alfol 12 is a mixture of alcohols containing mostly $C_{12}$ fatty alcohols. Alfol 1218 is a mixture of synthetic, primary, straightchain alcohols containing primarily 12 to 18 carbon atoms. The Alfol 20+ alcohols are mixtures of $C_{18}$–$C_{28}$ primary alcohols having mostly, on an alcohol basis, $C_{20}$ alcohols as determined by GLC (gas-liquid-chromatography). The Alfol 22+ alcohols are $C_{18}$–$C_{28}$primary alcohols containing primarily, on an alcohol basis, $C_{22}$ alcohols. These Alfol alcohols can contain a fairly large percentage (up to 40% by weight) of paraffinic compounds which can be removed before the reaction if desired.

Another example of a commercially available alcohol mixture is Adol 60 which comprises about 75% by weight of a straight chain ($C_{22}$ primary alcohol, about 15% of a $C_{20}$ primary alcohol and about 8% of $C_{18}$ and $C_{24}$ alcohols. Adol 320 comprises predominantly oleyl alcohol. The Adol alcohols are marketed by Ashland Chemical.

A variety of mixtures of monohydric fatty alcohols derived from naturally occurring triglycerides and ranging in chain length of from $C_8$ to $C_{18}$ are available from Proctor & Gamble Company. These mixtures contain various amounts of fatty alcohols containing mainly 12, 14, 16, or 18 carbon atoms. For example, CO-1214 is a fatty alcohol mixture containing 0.5% of $C_{10}$ alcohol, 66.0% of $C_{12}$ alcohol, 26.0% of $C_{14}$ alcohol and 6.5% of $C_{16}$ alcohol.

Another group of commercially available mixtures include the "Neodol" products available from Shell Chemical Co. For example, Neodol 23 is a mixture of $C_{12}$ and $C_{13}$ alcohols; Neodol 25 is a mixture of $C_{12}$ and $C_{15}$ alcohols; and Neodol 45 is a mixture of $C_{14}$ to $C_{15}$ linear alcohols. Neodol 91 is a mixture of $C_9$, $C_{10}$ and $C_{11}$ alcohols.

Fatty vicinal diols also are useful and these include those available from Ashland Oil under the general trade designation Adol 114 and Adol 158. The former is derived from a straight chain alpha olefin fraction of $C_{11}$–$C_{14}$, and the latter is derived from a $C_{15}$–$C_{18}$ fraction.

Examples of useful phosphorus acid esters include the phosphoric acid esters prepared by reacting a phosphoric acid or anhydride with cresol alcohols. An example is tricresol phosphate.

In one embodiment, the phosphorus acid ester is a monothio-phosphoric acid ester or a monothiophosphate. Monothiophosphates are prepared by the reaction of a sulfur source and a dihydrocarbyl phosphite. The sulfur source may be elemental sulfur, a monosulfide, such as a sulfur coupled olefin or a sulfur coupled dithiophosphate. Elemental sulfur is a preferred sulfur source. The preparation of monothiophosphates is disclosed in U.S. Pat. No. 4,755,311 and PCT Publication WO 87/07638 which are incorporated herein by reference for their disclosure of monothiophosphates, sulfur sources for preparing monothiophosphates and the process for making monothiophosphates.

Monothiophosphates may also be formed in the lubricant blend or functional fluid by adding a dihydrocarbyl phosphite to a lubricating composition or functional fluid containing a sulfur source. The phosphite may react with the sulfur source under blending conditions (i.e., temperatures from about 30° C. to about 100° C. or higher) to form the monothiophosphate.

In one embodiment, the phosphorous acid is a dithiophosphoric acid or phosphorodithioic acid. The dithiophosphoric acid can be reacted with an epoxide or a glycol to form an intermediate. The intermediate is then reacted with a phosphorus acid, anhydride, or lower ester. The epoxide is generally an aliphatic epoxide or a styrene oxide. Examples of useful epoxides include ethylene oxide, propylene oxide, butene oxide, octene oxide, dodecane oxide, styrene oxide, etc. Propylene oxide is preferred. The glycols may be aliphatic glycols having from 1 to about 12, preferably about 2 to about 6, more preferably 2 or 3 carbon atoms, or aromatic glycols. Aliphatic glycols include ethylene glycol, propylene glycol, triethylene glycol and the like. Aromatic glycols include hydroquinone, catechol, resorcinol, and the like. These are described in U.S. Pat. No. 3,197,405 which is incorporated herein by reference for its disclosure of dithiophosphoric acids, glycols, epoxides, inorganic phosphorus reagents and methods of reacting the same.

When the phosphorus acid esters are acidic, they may be reacted with an amine compound or metallic base to form the corresponding amine or metal salt. The salts may be formed separately and then the salt of the phosphorus acid ester is added to the lubricant or functional fluid composition. Alternatively, the salts may also be formed when the phosphorus acid ester is blended with other components to form the lubricating composition. The phosphorus acid ester could then form salts with basic materials which are in the lubricant or functional fluid composition such as basic nitrogen containing compounds (e.g., carboxylic dispersants) and overbased materials.

The amine salts of the phosphorus acid esters may be formed from ammonia, or a primary, secondary or tertiary amine, or mixtures thereof. These amines can be monoamines or polyamines. Useful amines include those amines discussed above under the headings "(A)(II) Polyamines." Also useful are the amines disclosed in U.S. Pat. No. 4,234,435 at Col. 1, line 4, to Col. 27, line 50; these pages being incorporated herein by reference.

The metal salts of the phosphorus acid esters are prepared by the reaction of a metal base with the phosphorus acid ester. The metal base may be in any convenient form such as oxide, hydroxide, carbonate, sulfate, borate, or the like. The metals of the metal base include Group IA, IIA, IB through VIIB and VIII metals (CAS version of the Periodic Table of the Elements). These metals include the alkali metals, alkaline earth metals and transition metals. In one embodiment, the metal is a Group IIA metal such as calcium or magnesium, Group IIB metal such as zinc, or a Group VIIB metal such as manganese. In one embodiment the metal is magnesium, calcium, manganese or zinc.

The phosphorous acid ester can be a phosphite. In one embodiment, the phosphite is a di- or trihydrocarbyl phosphite. Each hydrocarbyl group can have from 1 to about 24 carbon atoms, or from 1 to about 18 carbon atoms, or from about 2 to about 8 carbon atoms. Each hydrocarbyl group may be independently alkyl, alkenyl or aryl. When the hydrocarbyl group is an aryl group, then it contains at least about 6 carbon atoms; and in one embodiment about 6 to about 18 carbon atoms. Examples of the alkyl or alkenyl groups include propyl, butyl, hexyl, heptyl, octyl, oleyl, linoleyl, stearyl, etc. Examples of aryl groups include phenyl, naphthyl, heptylphenol, etc. In one embodiment each hydrocarbyl group is independently propyl, butyl, pentyl, hexyl, heptyl, oleyl or phenyl, more preferably butyl, oleyl or phenyl and more preferably butyl or oleyl. Phosphites and their preparation are known and many phosphites are available commercially. Useful phosphites are dibutylhydrogen phosphite, trioleyl phosphite and triphenyl phosphite. In one embodiment, the phosphite is the product made by reacting alpha-pinene with $P_2S_5$ at a molar ratio of 4:1.

In one embodiment, the phosphorus acid derivative is a phosphorus-containing amide. The phosphorus-containing amides may be prepared by the reaction of a phosphorus acid (e.g., a dithiophosphoric acid as described above) with an unsaturated amide. Examples of unsaturated amides include acrylamide, N,N$_\epsilon$-methylene bisacrylamide, methacrylamide, crotonamide, and the like. The reaction product of the phosphorus acid with the unsaturated amide may be further reacted with linking or coupling compounds, such as formaldehyde or paraformaldehyde to form coupled compounds. The phosphorus-containing amides are known in the art and are disclosed in U.S. Pat. Nos. 4,876,374, 4,770,807 and 4,670,169 which are incorporated by reference for their disclosures of phosphorus amides and their preparation.

In one embodiment, the phosphorous acid ester is a phosphorus-containing carboxylic ester. The phosphorus-containing carboxylic esters may be prepared by reaction of one of the above-described phosphorus acids, such as a dithiophosphoric acid, and an unsaturated carboxylic acid or ester, such as a vinyl or allyl acid or ester. If the carboxylic acid is used, the ester may then be formed by subsequent reaction with an alcohol.

The vinyl ester of a carboxylic acid may be represented by the formula RCH=CH-O(O)CR$^1$ wherein R is a hydrogen or hydrocarbyl group having from 1 to about 30 carbon atoms, preferably hydrogen or a hydrocarbyl group having 1 to about 12, more preferably hydrogen, and R$^1$ is a hydrocarbyl group having 1 to about 30 carbon atoms, or 1 to about 12, or 1 to about 8. Examples of vinyl esters include vinyl acetate, vinyl 2-ethylhexanoate, vinyl butanoate, and vinyl crotonate.

In one embodiment, the unsaturated carboxylic ester is an ester of an unsaturated carboxylic acid, such as maleic, fumaric, acrylic, methacrylic, itaconic, citraconic acids and the like. The ester can be represented by the formula RO-(O)CHC=CH-C(O)OR wherein each R is independently a hydrocarbyl group having 1 to about 18 carbon atoms, or 1 to about 12, or 1 to about 8 carbon atoms.

Examples of unsaturated carboxylic esters that are useful include methylacrylate, ethylacrylate, 2-ethylhexylacrylate, 2-hydroxyethylacrylate, ethylmethacrylate, 2-hydroxyethylmethacrylate, 2-hydroxypropylmethacrylate, 2-hydroxypropylacrylate, ethylmaleate, butylmaleate and 2-ethylhexylmaleate. The above list includes mono- as well as diesters of maleic, fumaric and citraconic acids.

In one embodiment, the phosphorous acid is the reaction product of a phosphorus acid and a vinyl ether. The vinyl ether is represented by the formula R-CH$_2$=CHOR$^1$ wherein R is hydrogen or a hydrocarbyl group having I to about 30, preferably 1 to about 24, more preferably 1 to about 12 carbon atoms, and R$^1$ is a hydrocarbyl group having 1 to about 30 carbon atoms, preferably 1 to about 24, more preferably 1 to about 12 carbon atoms. Examples of vinyl ethers include vinyl methylether, vinyl propylether, vinyl 2-ethylhexylether and the like.

(D) Thiocarbamate

The thiocarbamates (D) are compounds represented by the formula $$R^1R^2N\text{-}C(X)S\text{-}(CR^3R^4)_8Y$$

where R$^1$, R$^2$, R$^3$ and R$^4$ are independently hydrogen or hydrocarbyl groups, provided that at least one of R$^1$ or R$^2$ is a hydrocarbyl group; X is oxygen or sulfur; a is 1 or 2; and Y is a hydrocarbyl group, a hetero group (that is, a group attached through a heteroatom such as O, N, or S), an additional —SC(X)-NR$^1$R$^2$ group, or an activating group.

When a is 2, Y is an activating group. In describing Y as an "activating group," what is meant is a group which will activate an olefin to which it is attached toward nucleophilic addition by, e.g., CS$_2$ or COS derived intermediates. (This is reflective of the method by which this material is normally prepared, by reaction of an activated olefin with CS$_2$ and an amine.) The activating group Y can be, for instance, an ester group, typically but not necessarily a carboxylic ester group of the structure COOR—COOR$^5$. It can also be an ester group based on a non-carbon acid, such as a sulfonic or sulfinic ester or a phosphonic or phosphinic ester. The activating group can also be any of the acids corresponding to the aforementioned esters. Y can also be an amide group, that is, based on the condensation of an acid group, preferably a carboxylic acid group, with an amine. In that case the —(CR$^3$R$^4$)$_8$Y group can be derived from acrylamide. Y can also be an ether group, —OR$^5$; a carbonyl group, that is, an aldehyde or a ketone group; a cyano group, —CN, or an aryl group. In one embodiment Y is an ester group of the structure, —COOR$^5$, where R$^5$ is a hydrocarbyl group. R$^5$ can comprise 1 to about 18 carbon atoms, and in one embodiment 1 to about 6 carbon atoms. In one embodiment R$^5$ is methyl so that the activating group is —COOCH$_3$.

When a is 1, Y need not be an activating group, because the molecule is generally prepared by methods, described below, which do not involve nucleophilic addition to an activated double bond.

R$^3$ and R$^4$ can be, independently, hydrogen or methyl or ethyl groups. When a is 2, at least one of R$^3$ and R$^4$ is normally hydrogen so that this compound will be R$^1$R$^2$N-C(S)S-CR$^3$R$^4$CR$^3$HCOOR$^5$. In one embodiment most or all of the R$^3$ and R$^4$ groups are hydrogen so that the thiocarbamate will be R$^1$R$^2$N-C-(S)S=CH$_2$CH$_2$COOCH$_3$. (These materials can be derived from methyl methacrylate and methylacrylate, respectively.) These and other materials containing appropriate activating groups are disclosed in greater detail in U.S. Pat. No. 4,758,362, which is incorporated herein by reference.

The substituents R$^1$ and R$^2$ on the nitrogen atom are likewise hydrogen or hydrocarbyl groups, but at least one should be a hydrocarbyl group. It is generally believed that at least one such hydrocarbyl group is desired in order to provide a measure of oil-solubility to the molecule. However, $R^1$ and $R^2$ can both be hydrogen, provided the other R groups in the molecule provide sufficient oil solubility to the molecule. In practice this means that at least one of the groups $R^3$ or $R^4$ should be a hydrocarbyl group of at least 4 carbon atoms. $R^1$ or $R^2$ are preferably alkyl groups of 1 to about 18 carbon atoms, and in one embodiment alkyl groups of 1 to about 8 carbon atoms. In one embodiment, both $R^1$ and $R^2$ are butyl groups. Thus, in one embodiment, the thiocarbamate (D) is S-carbomethoxyethyl-N,N-dibutyl dithiocarbamate which can be represented by the formula

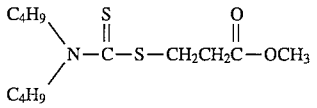

Materials of this type can be prepared by a process described in U.S. Pat. No. 4,758,362. Briefly, these materials are prepared by reacting an amine, carbon disulfide or carbonyl sulfide, or source materials for these reactants, and a reactant containing an activated, ethylenically-unsaturated bond or derivatives thereof. These reactants are charged to a reactor and stirred, generally without heating, since the reaction is normally exothermic. Once the reaction reaches the temperature of the exotherm (typically 40°–65° C.), the reaction mixture is held at the temperature to insure complete reaction. After a reaction time of typically 3–5 hours, the volatile materials are removed under reduced pressure and the residue is filtered to yield the final product.

The relative amounts of the reactants used to prepare these compounds are not critical. The charge ratios to the reactor can vary where economics and the amount of the product desired are controlling factors. Thus, the molar charge ratio of the amine to the $CS_2$ or COS reactant to the ethylenically unsaturated reactant may vary in the ranges 5:1:1 to 1:5:1 to 1:1:5. In one embodiment, the charge ratios of these reactants is 1:1:1.

In the case where a is 1, the activating group Y is separated from the sulfur atom by a methylene group. Materials of this type can be prepared by reaction of sodium dithiocarbamate with a chlorine-substituted material. Such materials are described in greater detail in U.S. Pat. No. 2,897,152, which is incorporated herein by reference.

(E) Nitrogen-Containing Ester of Carboxy-Containing Interpolymers

In one embodiment the inventive compositions contain a nitrogen-containing ester of a carboxy-containing interpolymer. These polymers can be nitrogen-containing mixed esters of carboxy-containing interpolymers having a reduced specific viscosity of from about 0.05 to about 2, said ester being characterized by the presence within its polymeric structure of at least one of each of three pendant polar groups: (A) a relatively high molecular weight carboxylic ester group having at least 8 aliphatic carbon atoms in the ester radical, (B) a relatively low molecular weight carboxylic ester group having no more than 7 aliphatic carbon atoms in the ester radical, and (C) a carbonyl-polyamino group derived from a polyamino compound having one primary or secondary amino group. In one embodiment, the molar ratio of (A):(B):(C)is (60–90):(10–30):(2–15).

In reference to the size of the ester groups, it is pointed out that an ester group is represented by the formula

—C(O)(OR)

and that the number of carbon atoms in an ester group is thus the combined total of the carbon atom of the carbonyl group and the carbon atoms of the ester group, i.e., the (OR) group.

As used herein, the reduced specific viscosity (abbreviated as RSV) is the value obtained in accordance with the formula $$RSV = \frac{\text{Relative Viscosity} - 1}{\text{Concentration}}$$

wherein the relative viscosity is determined by measuring, by means of a dilution viscometer, the viscosity of a solution of one gram of the interpolymer in 100 ml of acetone and the viscosity of acetone at 3020 ±0.02° C. For purpose of computation by the above formula, the concentration is adjusted to 0.4 gram of the interpolymer per 100 ml of acetone.

While interpolymers having a reduced specific viscosity of from about 0.05 to about 2 are contemplated in the present invention, also useful are interpolymers are those having a reduced specific viscosity of from about 0.3 to about 1, and in one embodiment about 0.5 to about 1.

In one embodiment, the nitrogen-containing mixed esters are those in which the high molecular weight ester group has from 8 to 24 aliphatic carbon atoms, the low molecular weight ester group has from 3 to 5 carbon atoms and the carbonyl polyamino group is derived from a primary-aminoalkyl-substituted tertiary amine, an example being a heterocyclic amine. Specific examples of the high molecular weight carboxylic ester group, i.e., the (OR) group of the ester group (i.e., —(O)(OR)) include heptyloxy, isoctyloxy, decyloxy, dodecyloxy, tridecyloxy, pentadecyloxy, octadecyloxy, eicosyloxy, tricosyloxy, tetracosyloxy, heptacosyloxy, triacontyloxy, bentriacontyloxy, tetracontyloxy, etc. Specific examples of low molecular weight groups include methyloxy, ethyloxy, n-propyloxy, isopropyloxy, n-butyloxy, sec-butyloxy, iso-butyloxy, n-pentyloxy, neo-pentyloxy, n-hexyloxy, cyclohexyloxy, cyclopentyloxy, 2-methylbutyl-1-oxy, 2,3-dimethyl-butyl-1-oxy, etc. In most instances, alkoxy groups of suitable size comprise the high and low molecular weight ester groups. Polar substituents may be present in such ester groups. Examples of polar substituents are chloro, bromo, ether, nitro, etc.

Examples of the carbonyl group include those derived from polyamino compounds having one primary or secondary amino group and at least one mono-functional amino group such as tertiary amino or heterocyclic amino group. Such compounds may thus be tertiary amino-substituted primary or secondary amines or other substituted primary or secondary amines in which the substituent is derived from pyrroles, pyrrolidones, caprolactams, oxazolidones, oxazoles, thiazoles, pyrazoles, pyrazolines, imidazoles, imidazolines, thiazines, oxazines, diazines, oxycarbamyl, thiocarbamyl, uracils, hydantoins, thiohydantoins, guanidines, ureas, sulfonamides, phosphoroamides, phenolthiazines, amidines, etc. Examples of such polyamino compounds include dimethylamino-ethylamine, dibutyl-amino-ethylamine, 3-dimethylamino-1-propylamine, 4-methylethylamino-1-butylamine, pyridyl-ethylamine, N-morpholinoethylamine, tetrahydropyridyl-ethylamine, bis-(dimethylamino)propylamine, bis-(diethylamino)ethylamine, N,N-dimethyl-p-phenylene diamine, piperidyl-ethylamine, 1-aminoethyl pyrazone, 1-(methylamino)pyrazoline, 1-methyl-4-aminooctyl pyrazole, 1-aminobutyl imidazole, 4-aminoethyl thiazole, 2-aminoethyl triazine, dimethylcarbamyl propylamine, N-methyl-N-aminopropyl acetamide, N-aminoethyl succinimide, N-methylamino maleimide, N-aminobutyl-alphachlorosuccinimide, 3-aminoethyl uracil, 2-aminoethyl pyridine, ortho-aminoethyl-N,N-dimethylbenzenesulfamide, N-aminoethyl phenothiazine, N-aminoethylacetamidine, 1-aminophenyl-2-methyl-imidazoline, N-methyl-N-aminoethyl-S-ethyl-dithiocarbamate, etc. For the most part, the polyamines are those which contain only one primary amino or secondary amino group and, in one embodiment, at least one tertiary-amino group, The tertiary amino group is preferably a heterocyclic amino group. In some instances polyamine compounds may contain up to about 6 amino groups although, in most instances, they contain one primary amino group and either one or two tertiary amino groups. The polyamine compounds may be aromatic or aliphatic amines and are preferably heterocyclic amines such as amino-alkyl-substituted morpholines, piperazines, pyridines, benzopyrroles, quinolines, pyrroles, etc. They are usually amines having from about 4 to about 30 carbon atoms, and in one embodiment from 4 to about 12 carbon atoms. Polar substituents may likewise be present in the polyamines.

The carboxy-containing interpolymers include interpolymers of a,b-unsaturated acids or anhydrides such as maleic anhydride or itaconic anhydride with olefins (aromatic or aliphatic) such as ethylene, propylene, styrene, or isobutene. The styrene-maleic anhydride interpolymers are useful. They are obtained by polymerizing equal molar amounts of styrene and maleic anhydride, with or without one or more additional interpolymerizable comonomers. In lieu of styrene, an aliphatic olefin may be used, such as ethylene, propylene, isobutene. In lieu of maleic anhydride, acrylic acid or methacrylic acid or ester thereof may be used. Such interpolymers are known in the art.

The nitrogen-containing mixed esters are conveniently prepared by first esterifying the carboxy-containing interpolymer with a relatively high molecular weight alcohol and a relatively low molecular weight alcohol to convert at least about 50% and no more than about 98% of the carboxy groups of the interpolymer to ester radicals and then neutralizing the remaining carboxy groups with a polyamine such as described above. To incorporate the appropriate amounts of the two alcohol groups into the interpolymer, the ratio of the high molecular weight alcohol to the low molecular weight alcohol used in the process should be within the range of from about 2:1 to about 9:1 on a molar basis in most instances the ratio is from about 2.5:1 to about 5:1. More than one high molecular weight alcohol or low molecular weight alcohol may be used in the process; so also may be used commercial alcohol mixtures such as the so-called Oxo-alcohols which comprise, for example, mixtures of alcohols having from about 8 to about 24 carbon atoms. A useful class of alcohols are the commercial alcohols or alcohol mixtures comprising octyl alcohol, decyl alcohol, dodecyl alcohol, tetradecyl alcohol, pentadecyl alcohol, eicosyl alcohol, and octadecyl alcohol. Other alcohols useful in the process are illustrated by those which, upon esterification, yield the ester groups exemplified above.

The extent of esterification, as indicated previously, may range from about 50% to about 98% conversion of the carboxy groups of the interpolymer to ester groups. In one embodiment, the degree of esterification ranges from about 75% to about 95%.

The esterification can be accomplished simply by heating the carboxy-containing interpolymer and the alcohol or alcohols under conditions typical for effecting esterification. Such conditions usually include, for example, a temperature of at least about 80° C., and in one embodiment from about 150° C. to about 350° C., provided that the temperature be below the decomposition point of the reaction mixture, and the removal of water of esterification as the reaction proceeds. Such conditions may optionally include the use of an excess of the alcohol reactant so as to facilitate esterification, the use of a solvent or diluent such as mineral oil, toluene, benzene, xylene or the like and an esterification catalyst such as toluene sulfonic acid, sulfuric acid, aluminum chloride, boron trifluoride-triethylamine, hydrochloric acid, ammonium sulfate, phosphoric acid, sodium methoxide or the like. These conditions and variations thereof are well known in the art.

A useful method of effecting esterification involves first reacting the carboxy-containing interpolymer with the relatively high molecular weight alcohol and then reacting the partially esterified interpolymer with the relatively low molecular weight alcohol. A variation of this technique involves initiating the esterification with the relatively high molecular weight alcohol and before such esterification is complete, the relatively low molecular weight alcohol is introduced into the reaction mass so as to achieve a mixed esterification. In either event it has been discovered that a two-step esterification process whereby the carboxy-containing interpolymer is first esterified with the relatively high molecular weight alcohol so as to convert from about 50% to about 75% of the carboxy groups to ester groups and then with the relatively low molecular weight alcohol to achieve the finally desired degree of esterification results in products which have unusually beneficial viscosity properties.

The esterified interpolymer is then treated with a polyamino compound in an amount so as to neutralize substantially all of the unesterified carboxy groups of the interpolymer. The neutralization can be carried out at a temperature of at least about 80° C., often from about 120° C. to about 300° C., provided that the temperature does not exceed the decomposition point of the reaction mass. In most instances the neutralization temperature is between about 150° C. and 250° C. A slight excess of the stoichiometric amount of the polyamino compound is often desirable, so as to insure substantial completion of neutralization, i.e., no more than about 2% of the carboxy groups initially present in the interpolymer remained unneutralized.

Lubricating Compositions and Functional Fluids

The lubricant and functional fluid compositions of the present invention are based on diverse oils of lubricating viscosity, including natural and synthetic lubricating oils and mixtures thereof. The lubricating compositions may be lubricating oils and greases useful in industrial applications and in automotive engines, transmissions and axles. These lubricating compositions are effective in a variety of applications including crankcase lubricating oils for spark-ignited and compression-ignited internal combustion engines, including automobile and truck engines, two-cycle engines, aviation piston engines, marine and low-load diesel engines, and the like. Also, automatic transmission fluids, transaxle lubricants, gear lubricants, metal-working lubricants, hydraulic fluids, and other lubricating oil and grease compositions can benefit from the incorporation of the compositions of this invention. The inventive functional fluids are particularly effective as automatic transmission fluids having enhanced torque properties.

The lubricants and functional fluid compositions of this invention employ an oil of lubricating viscosity which is generally present in a major amount (i.e. an amount greater than about 50% by weight). Generally, the oil of lubricating viscosity is present in an amount greater than about 60%, or greater than about 70%, or greater than about 80% by weight of the composition.

The natural oils useful in making the inventive lubricants and functional fluids include animal oils and vegetable oils (e.g., castor oil, lard oil) as well as mineral lubricating oils such as liquid petroleum oils and solvent treated or acid-treated mineral lubricating oils of the paraffinic, naphthenic or mixed paraffinicnaphthenic types. Oils of lubricating viscosity derived from coal or shale are also useful. Synthetic lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, etc.); poly(1-hexenes), poly-(1-octenes), poly(1-decenes), etc. and mixtures thereof; alkyl-benzenes (e.g., dodecylbenzenes, tetradecylbenzenes, dinonylbenzenes, di-(2-ethyl-hexyl)-benzenes, etc.); polyphenyls (e.g., biphenyls, terphenyls, alkylated polyphenyls, etc.); alkylated diphenyl ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc., constitute another class of known synthetic lubricating oils that can be used. These are exemplified by the oils prepared through polymerization of ethylene oxide or propylene oxide, the alkyl and aryl ethers of these polyoxyalkylene polymers (e.g., methyl-poly-isopropylene glycol ether having an average molecular weight of about 1000, diphenyl ether of polyethylene glycol having a molecular weight of about 500–1000, diethyl ether of polypropylene glycol having a molecular weight of about 1000–1500, etc.) or mono- and polycarboxylic esters thereof, for example, the acetic acid esters, mixed ($C_{3-8}$ fatty acid esters, or the $C_{13}$Oxo acid diester of tetraethylene glycol.

Another suitable class of synthetic lubricating oils that can be used comprises the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.) Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include those made from $C_5$ to $C_{12}$ monocarboxylic acids and polyols and polyol ethers such as neopentyl glycol, trimethylol propane, pentaerythritol, dipentaerythritol, tripentaerythritol, etc.

Silicon-based oils such as the polyalkyl-, polyaryl-, polyalkoxy-, or polyaryloxy-siloxane oils and silicate oils comprise another useful class of synthetic lubricants (e.g., tetraethyl silicate, tetraisopropyl silicate, tetra-(2-ethylhexyl)silicate, tetra-(4-methylhexyl)silicate, tetra-(p-tert-butylphenyl) silicate, hexyl-(4-methyl-2-pentoxy)disiloxane, poly(methyl) siloxanes, poly-(methylphenyl)siloxanes, etc.). Other synthetic lubricating oils include liquid esters of phosphorus-containing acids (e.g., tricresyl phosphate, trioctyl phosphate, diethyl ester of decane phosphonic acid, etc.), polymeric tetrahydrofurans and the like.

Unrefined, refined and rerefined oils, either natural or synthetic (as well as mixtures of two or more of any of these) of the type disclosed hereinabove can be used in the lubricants of the present invention. Unrefined oils are those obtained directly from a natural or synthetic source without further purification treatment. For example, a shale oil obtained directly from retorting operations, a petroleum oil obtained directly from primary distillation or ester oil obtained directly from an esterification process and used without further treatment would be an unrefined oil. Refined oils are similar to the unrefined oils except they have been further treated in one or more purification steps to improve one or more properties. Many such purification techniques are known to those skilled in the art such as solvent extraction, secondary distillation, acid or base extraction, filtration, percolation, etc. Rerefined oils are obtained by processes similar to those used to obtain refined oils applied to refined oils which have been already used in service. Such rerefined oils are also known as reclaimed or reprocessed oils and often are additionally processed by techniques directed to removal of spent additives and oil breakdown products.

In one embodiment, the oil of lubricating viscosity is a poly-alpha-olefin (PAO). Typically, the poly-alpha-olefins are derived from monomers having from about 4 to about 30, or from about 4 to about 20, or from about 6 to about 16 carbon atoms. Examples of useful PAOs include those derived from decene. These PAOs may have a viscosity from about 3 to about 150, or from about 4 to about 100, or from about 4 to about 8 cSt at 100° C. Examples of PAOs include 4 cSt poly-alpha-olefins, 6 cSt poly-alpha-olefins, 40 cSt poly-alpha-olefins and 100 cSt poly-alpha-olefins. Mixtures of mineral oils with the foregoing poly-alpha-olefins can be useful.

Generally, the lubricants and functional fluids of the present invention contain the inventive composition (i.e., components (A), (B), (C) and optionally (D) and/or (E)) at a combined concentration in the range of about 0.01% to about 30% by weight, and in one embodiment about 0.05% to about 20% by weight of the total weight of the lubricant or functional fluid. Generally, component (A) is employed at a concentration in the range of about 0.5% to about 4%, and in one embodiment about 1% to about 3%, and in one embodiment about 1.5% to about 2.5% by weight based on the total weight of the lubricant or functional fluid. Component (B) is generally employed at a concentration in the range of about 0.1% to about 1.5%, and in one embodiment from about 0.2% to about 1%, and in one embodiment from about 0.3% to about 0.7% by weight based on the total weight of the lubricant or functional fluid. Component (C) is generally employed at a concentration in the range of about 0.01% to about 5%, and in one embodiment from about 0.02% to about 2%, and in one embodiment from about 0.05% to about 1% by weight based on the total weight of the lubricant or functional fluid. Component (D) is an optional component, but when used it is employed at a concentration generally in the range of up to about 1% by weight, and in one embodiment from about 0.1% to about 0.8%, and in one embodiment from about 0.4% to about 0.6% by weight based on the total weight of the lubricant or functional fluid. Component (E) is an optional component, but when used it is employed at a concentration generally in the range of up to about 5 % by weight, and in one embodiment from about 0.5% to about 4%, and in one embodiment from about 1% to about 2.5% by weight based on the total weight of the lubricant or functional fluid.

In one embodiment, the inventive functional fluid is an automatic transmission fluid (ATF) and the concentration of component (A) is at a sufficient concentration to provide the ATF with enhanced friction stability and increased levels of friction; component (B) is at a sufficient concentration to provide the ATF with enhanced antiwear, friction and seal compatibility properties, and component (C) is at a sufficient concentration to provide the ATF with enhanced antiwear and/or antioxidant characteristics.

The invention also contemplates the use of lubricants and functional fluids containing other additives in addition to the compositions of this invention. Such additives include, for example, detergents and dispersants, corrosion-inhibiting agents, antioxidants, viscosity-index improving agents, extreme pressure (E.P.) agents, pour point depressants, friction modifiers, fluidity modifiers, seal swell agents, color stabilizers, dyes, anti-foam agents, etc.

The inventive lubricating compositions and functional fluids can contain one or more detergents or dispersants of the ash-producing or ashless type. The ash-producing detergents are exemplified by oil-soluble neutral and basic salts of alkali or alkaline earth metals with sulfonic acids, carboxylic acids, or organic phosphorus acids characterized by at least one direct carbon-to-phosphorus linkage such as those prepared by the treatment of an olefin polymer (e.g., polyisobutene having a molecular weight of 1000) with a phosphorizing agent such as phosphorus trichloride, phosphorus heptasulfide, phosphorus pentasulfide, phosphorus trichloride and sulfur, white phosphorus and a sulfur halide, or phosphorothioic chloride. The most commonly used salts of such acids are those of sodium, potassium, lithium, calcium, magnesium, strontium and barium.

Ashless detergents and dispersants are so called despite the fact that, depending on its constitution, the dispersant may upon combustion yield a non-volatile material such as boric oxide or phosphorus pentoxide; however, it does not ordinarily contain metal and therefore does not yield a metal-containing ash on combustion. Many types are known in the art, and any of them are suitable for use in the lubricant compositions and functional fluids of this invention. The following are illustrative:

(1) Reaction products of carboxylic acids (or derivatives thereof) containing at least about 34 and preferably at least about 54 carbon atoms with nitrogen containing compounds such as amine, organic hydroxy compounds such as phenols and alcohols, and/or basic inorganic materials. Examples of these "carboxylic dispersants" are described in many U.S. Pat. Nos. including 3,219,666; 4,234,435; and 4,938,881. These include the products formed by the reaction of a polyisobutenyl succinic anhydride with an amine such as a polyethylene amine.

(2) Reaction products of relatively high molecular weight aliphatic or alicyclic halides with amines, preferably oxyalkylene polyamines. These may be characterized as "amine dispersants" and examples thereof are described for example, in the following U.S. Pat. Nos.: 3,275,554; 3,438,757; 3,454,555; and 3,565,804.

(3) Reaction products of alkyl phenols in which the alkyl group contains at least about 30 carbon atoms with aldehydes (especially formaldehyde) and amines (especially polyalkylene polyamines), which may be characterized as "Mannich dispersants." The materials described in the following U.S. Pat. Nos. are illustrative: 3,649,229; 3,697,574; 3,725,277; 3,725,480; 3,726,882; and 3,980,569.

(4) Products obtained by post-treating the amine or Mannich dispersants with such reagents as urea, thiourea, carbon disulfide, aldehydes, ketones, carboxylic acids, hydrocarbon-substituted succinic anhydrides, nitriles, epoxides, boron compounds, phosphorus compounds or the like. Exemplary materials of this kind are described in the following U.S. Pat. Nos.: 3,639,242; 3,649,229; 3,649,659; 3,658,836; 3,697,574; 3,702,757; 3,703,536; 3,704,308; and 3,708,422.

(5) Interpolymers of oil-solubilizing monomers such as decyl methacrylate, vinyl decyl ether and high molecular weight olefins with monomers containing polar substituents, e.g., aminoalkyl acrylates or acrylamides and poly-(oxyethylene)-substituted acrylates. These may be characterized as "polymeric dispersants." and examples thereof are disclosed in the following U.S. Pat. Nos.: 3,329,658; 3,449,250; 3,519,565; 3,666,730; 3,687,849; and 3,702,300.

The above-noted patents are incorporated by reference herein for their disclosures of ashless dispersants.

The inventive lubricating compositions and functional fluids can contain one or more extreme pressure, corrosion inhibitors and/or oxidation inhibitors. Extreme pressure agents and corrosion- and oxidation-inhibiting agents which may be included in the lubricants and functional fluids of the invention are exemplified by chlorinated aliphatic hydrocarbons such as chlorinated wax; organic sulfides and polysulfides such as benzyl disulfide, bis(chlorobenzyl)disulfide, dibutyl tetrasulfide, sulfurized methyl ester of oleic acid, sulfurized alkylphenol, sulfurized dipentene, and sulfurized terpene; phosphosulfurized hydrocarbons such as the reaction product of a phosphorus sulfide with turpentine or methyl oleate; metal thiocarbamates, such as zinc dioctyldithiocarbamate, and barium heptylphenyl dithiocarbamate; dithiocarbamate esters from the reaction product of dithiocarbamic acid and acrylic, methacrylic, maleic, fumaric or itaconic esters; dithiocarbamate containing amides prepared from dithiocarbamic acid and an acrylamide; alkylene-coupled dithiocarbamates; sulfur-coupled dithiocarbamates. Group II metal phosphorodithioates such as zinc dicyclohexylphosphorodithioate, zinc dioctylphosphorodithioate, barium di(heptylphenyl)-phosphorodithioate, cadmium dinonylphosphoro- dithioate, and the zinc salt of a phosphorodithioic acid produced by the reaction of phosphorus pentasulfide with an equimolar mixture of isopropyl alcohol and n-hexyl alcohol.

Many of the above-mentioned extreme pressure agents and oxidation-inhibitors also serve as antiwear agents. Zinc dialkylphosphorodithioates are included in this group.

Pour point depressants are a useful type of additive often included in the lubricating oils and functional fluids described herein. The use of such pour point depressants in oil-based compositions to improve low temperature properties of oil-based compositions is well known in the art. See, for example, page 8 of "Lubricant Additives" by C.V. Smalheer and R. Kennedy Smith (LeziusHiles Co. publishers, Cleveland, Ohio, 1967). Examples of useful pour point depressants are polymethacrylates; polyacrylates; polyacrylamides; condensation products of haloparaffin waxes and aromatic compounds; vinyl carboxylate polymers; and terpolymers of dialkylfumarates, vinyl esters of fatty acids and alkyl vinyl ethers. A specific pour point depressant that can be used is the product made by alkylating naphthalene with polychlorinated paraffin and $C_{16}$–$C_{18}$ alpha-olefin. Pour point depressants useful for the purposes of this invention, techniques for their preparation and their uses are described in U.S. Pat. Nos. 2,387,501; 2,015,748; 2,655,479; 1,815,022; 2,191,498; 2,666,746; 2,721,877; 2,721,878; and 3,250,715 which are herein incorporated by reference for their relevant disclosures.

Anti-foam agents are used to reduce or prevent the formation of stable foam. Typical anti-foam agents include silicones or organic polymers. Additional antifoam compositions are described in "Foam Control Agents," by Henry T. Kerner (Noyes Data Corporation, 1976), pages 125–162.

Each of the foregoing additives, when used, is used at a functionally effective amount to impart the desired properties to the lubricant or functional fluid. Thus, for example, if an additive is a dispersant, a functionally effective amount of this dispersant would be an amount sufficient to impart the desired dispersancy characteristics to the lubricant or functional fluid. Similarly, if the additive is an extreme-pressure agent, a functionally effective amount of the extreme-pressure agent would be a sufficient amount to improve the extreme-pressure characteristics of the lubricant or functional fluid. Generally, the concentration of each of these additives, when used, ranges from about 0.001% to about 20% by weight, and in one embodiment about 0.01% to about 10% by weight based on the total weight of the lubricant or functional fluid.

Concentrates

Components (A), (B), (C) and optionally (D) and/or (E) of the inventive compositions as well as one of the other above-discussed additives or other additives known in the art can be added directly to the lubricant or functional fluid. In one embodiment, however, they are diluted with a substantially inert, normally liquid organic diluent such as mineral oil to form an additive concentrate. These concentrates usually contain from about 10% to about 90% by weight of the inventive composition (that is, components (A), (B), (C) and optionally (D) and/or (E)) and may contain, in addition, one or more other additives known in the art or described hereinabove. The remainder of the concentrate is the substantially inert normally liquid diluent.

EXAMPLES

Components (A), (B), (C), and optionally (D) and/or (E) of the invention were incoprorated into an automatic transmission fluid in weight percents based on the weight of the transmission fluid as shown in TABLE I. Other inclusions in the fluid are well known and for example include antioxidants, antifoam composition, pour point dispersants and the like.

TABLE I

| Weight of Components in ATF | |
|---|---|
| Component (A), high TBN dispersants | 0.05–5 |
| Component (B) Borated compounds including borated high TBN dispersants | 0.05–5 |
| Component (C) Dibutyl hydrogen phosphite | 0.01–5 |
| Component (D) S-Carbomethoxyethyl-N,N-dibutyl-dithiocarbamate | 0.05–2 |
| Component (E) Maleic anhydride-styrene copolymer esterified with $C_4$–$C_{18}$ alcohols, then reacted with aminopropylmorpholine | 0.05–7 |

For ATF formulations containing (A), (B), (C) and optionally (D) and/or (E) above in various combinations in an ATF enhanced torque characteristics of the ATF. To demonstrate this plate clutch function tests were performed using test equipment and parts specified in the Dexron®-III procedure. Table II gives test values for an ATF containing the above components. The results indicate that the formulations exhibit high stable midpoint dynamic torque and low delta torques. Delta torque is the difference between the maximum torque and the midpoint torque.

TABLE II

| | | 1 | 2 | 3 |
|---|---|---|---|---|
| Plate Clutch Friction Test | | | | |
| Mid Point Torque, N-m | Run-1 | 238 | 234 | 234 |
| | Run-2 | 242 | 223 | 210 |

TABLE II-continued

| | | 1 | 2 | 3 |
|---|---|---|---|---|
| Max Torque, N-m | Run-1 | 270 | 261 | 254 |
| | Run-2 | 264 | 244 | 242 |
| End Torque, N-m | Run-1 | 226 | 222 | 213 |
| | Run-2 | 227 | 213 | 206 |
| Delta Torque, N-m | Run-1 | 32 | 27 | 20 |
| | Run-2 | 22 | 21 | 32 |
| Lock-Up (sec) | Run-1 | 0.63 | 0.63 | 0.65 |
| | Run-2 | 0.62 | 0.66 | 0.71 |
| Test Length (hrs) | Run-1 | 1 | 1 | 1 |
| | Run-2 | 20 | 20 | 20 |

Mannich dispersants as well as acylated amine dispersants can be used in this invention. Also of use are borated Mannich dispersants which correlate to the borated acylated amine dispersants. The requirement for the Mannich dispersants is that they also be high TBN in the range of about 45–90. Mannich dispersants are well known in the art and in general are formed from reactions of alkyl phenols with formaldehyde and polyamines. A usual alkyl phenol is polyalkenyl substituted phenol where the range of molecular weight of the alkenyl group is about $M_n$ 300–3000. In addition to references cited herein above, other references to Mannich dispersants are U.S. Pat. Nos. 3,980,569; 4,454,059; and 4,053,428 which are herein incorporated by reference for disclosure of Mannich dispersants.

High TBN Mannich Dispersants

An example of a high TBN Mannich dispersant used in this invention is synthenzis as follows:

1. In the first step of the synthesis phenol is alkylated with polyisobutenyl of about $M_n$ 1000 (Ultravis 10 from British Petroleum) having at least 60% vinylidine end groups. The alkylation is $BF_3$ catalyzed. In this reaction 324 grams phenol, 9.2 grams $BF_3$, 332 grams toluene are mixed under $N_2$ and to this is added 1000 grams Ultravis 10 at a rate to keep the reaction temperature at 90°–100° F. The reaction mixture is then kept at 90°–100° F. for four hours at which time 9.2 grams of hydrated $Ca(OH)_2$ is added to neutralize the $BF_3$. The reaction mixture is vacuum stripped to yield the polyisobutenyl phenol.

2. A condensed polyamine is made by reacting under $N_2$ 1000 grams polyamine bottoms HPA-X from Union Carbide with 613 grams 40% concentrate of trishydroxymethylaminomethane from Angus Chemical Company, 15.9 grams 85% phosphoric acid. The mixture is heated to 350° F. after phosphoric acid addition. Conditions are maintained under which the amine will reflux and react while water is distilled off. The batch is heated to 440°–450° F. for ten hours and the low molecular weight amines are then removed by holding the batch temperature at 450°–460° F. for six hours without reflux. The batch is cooled to 200° F. and 127 grams water added followed by 22.1 grams 50% sodium hydroacid to yield one product.

3. To a mixture of 3290 grams of polyisobutenyl phenol synthesized above and 2400 grams of 100 neutral mineral oil is rapidly added the condensed polyamine of Step 2 above, 295 grams and the mixture held at 78° C. for 1.3 hour. To this is added 42.5 grams 91% paraformaldehyde at 78° C. and the mixture heated at 83° C. for 6.25 hours, the temperature is increased to 93°–98° C. and held for 2.5 hours. The temperature is then increased to 101 ° C. over one hour then increased to 158° C. in 1.8 hour more. The mixture is then held at 158° C. for 4.5 hours and filtered using filter aid Fax 5. This produces the Mannich dispersant product having an oil content of about 40% by weight and a TBN of about 60 on a chemical basis (oil free).

4. The high TBN Mannich dispersant of Step 3 is borated in the following manner. To 1000 grams of the product of Step 3 (about 40% oil) under $N_2$ is added 16.4 grams boric acid and 15 grams water at 90° C. The mixture is held at 90°–93° C. for 0.1 hour a few drops of antifoamer added. The mixture is held at 90°–93° C. for 1.5 hour, heated to 155° C. for four hours. The mixture is filtered through 35 grams of Fax 5 filter aid to yield the product. The product is roughly 40% oil and has a TBN of 51, a boron content of 0.256 percent by weight.

The Mannich dispersants may be used, as are acylated amine dispersants, in combination with the various components listed under (B)-(E) above and in combination with any other components listed above. The Mannich Dispersants may be substituted for the acetylated amine dispersants in any composition described hereabove. For instance the Mannich dispersants may be substituted for (A) in Table I. It should be understood that the amounts of (A) as either acylated amine dispersant or Mannich dispersant and their borated analogs are for products which are about 60% chemical and 40% oil and roughly 65% chemical and 35% oil respectively.

Compositions were made according to Table I in which high TBN Mannich dispersants were substituted for high TBN acylated amine dispersants. The 20-hour Plate Clutch Friction Test midpoint torque readings were comparable using both types of high TBN dispersants. In a composition of this invention, 3.5% by weight of the Mannich or acylated amine dispersant (40% oil) and 0.5% by weight of either borated analog (35 % oil) were mixed with the following other components and an oil of lubricating viscosity to give an ATF fluid. The other components and weight percent are as shown in the Table below.

TABLE III

| Component | Weight Percent | Weight Percent Range |
|---|---|---|
| Dibutylhydrogen Phosphite | 0.1 | 0.01–5 |
| Maleic anhydride-styrene viscosity modifier (65% oil) | 5.3 | 0.05–7 |
| S-Carbomethoxyethyl-N,N-dibutyl; dithiocarbamate | 0.5 | 0.05–3 |
| Dialkyl diphenylamine | 0.25 | 0.05–3 |
| Triphenyl monothiophosphate | 0.28 | 0.05–3 |
| Hydroxypropyl-t-dodecylmercaptan, or | 0.75 | 0.05–3 |
| Alkylthio alkanol self-condensation products | 0.75 | 0.05–3 |

A further composition useful to compositions containing high TBN dispersants are the self- condensation reaction products of alkylthio alhanols. Such compounds are revealed in U.S. Ser. No. 08/533,601 which is incorporated herein by reference. The self-condensation products are represented by the formula:

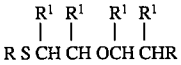

wherein R = $C_4$–$C_{20}$ and $R^1$ = hydrogen or hydrocarbyl.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A lubricating composition having improved torque characteristics, said composition comprising:

An oil of lubricating viscosity and a concentrate package mixed therewith, said concentrate package comprising:

(A) 0.5–5 percent by weight of Mannich dispersant having total base number (TBN) of about 45–90;

(B) 0.5–5 percent by weight of a borated dispersant;

(C) 0.05–5 percent by weight of an organic phosphorus acid or ester;

(D) up to 2 percent by weight of a dithiocarbamate; and (E) up to 7 percent by weight of a nitrogen-containing ester of a carbonyl-containing interpolymer, wherein the percents by weight are based on the weight of said lubricating compositions.

2. The composition according to claim 1, said composition further comprising a boron-containing compound selected from the group consisting of:

boron oxide, boron trioxide, boron trifluoride, boron tribromide, boron trichloride, boric acid tetraboric acid, metaboric acid, a boronic acid, a boric anhydride, a boron amide, an ester of boric acid, borated epoxide, borated fatty acid ester of glycerol.

3. The composition of claim 1 wherein (C) is a phosphonic acid, phosphinic acid, thiophosphinic acid, thiophosphonic acid, or a metal or amine salt of a phosphorus acid ester.

4. The composition of claim 1 wherein (C) is a compound represented by the formula

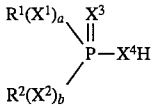

wherein $X^1$, $X^2$ and $X^3$ and $X^4$ are independently O or S, and $X^1$ and $X^2$ can be $NR^3$, a and b are independently zero or 1, and $R^1$, $R^2$ and $R^3$ are independently hydrocarbyl groups and $R^3$ can be hydrogen.

5. The composition of claim 1 wherein (C) is at least one pentavalent phosphorus derivative represented by the formula

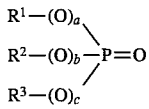

wherein $R^1$, $R^2$ and $R^3$ are independently hydrogen or hydrocarbyl groups with the proviso that at least one of $R^1$, $R_2$ or $R^3$ must be a hydrocarbyl group, and a, b and c are independently zero or 1.

6. The composition of claim 1 wherein (C) is at least one trivalent phosphorus derivative represented by the formula

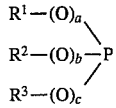

wherein $R^1$, $R^2$ and $R^3$ are independently hydrogen or hydrocarbyl groups with the proviso that at least one of $R^1$, $R^2$ or $R^3$ must be a hydrocarbyl group, and a, b and c are independently zero or 1.

7. The composition of claim 1 wherein (C) is dibutyl hydrogen phosphite.

8. The composition of claim 1 wherein (D) is a compound represented by the formula $R^1r^2N—(X)S—(CR^3R^4)_aZ$ wherein: $R^1$, $R^2$, $R^3$ and $R^4$ are independently hydrogen or hydrocarbyl groups, provided that at least one of $R^1$ and $R^2$ is a hydrocarbyl group; X is oxygen or sulfur; a is 1 or 2; and Z is an activating group, a hydrocarbyl group, a hetero group, or a —SC(X)—$NR^1R^2$ group, provided that when a is 2, Z is an activating group.

9. The composition of claim 1 wherein (D) is a compound represented by the formula

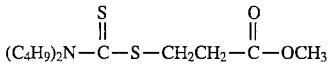

10. The composition of claim 1 wherein (E) is a nitrogen-containing mixed ester of a carboxy-containing interpolymer having a reduced specific viscosity of from about 0.05 to about 2, said ester being characterized by the presence within its polymeric structure of at least one of each of three pendant polar groups: (a) a relatively high molecular weight carboxylic ester group having at least 8 aliphatic carbon atoms in the ester group; (b) a relatively low molecular weight carboxylic ester group having no more than 7 aliphatic carbon atoms in the ester group; and (c) a carbonyl-polyamino group derived from a polyamine having one primary or secondary amino group.

11. The composition of claim 1 wherein (E) is a copolymer of styrene and maleic anhydride.

12. The composition of claim 1, said composition further comprising a component selected from the group consisting of corrosion-inhibiting agents, detergents, dispersants, antioxidants, viscosity-improving agents, antiwear agents, extreme-pressure agents, pour-point depressants, friction-modifiers, fluidity-modifiers, seal swell agents, color stabilizers, dyes, anti-foam agents, or mixtures thereof.

* * * * *